US007890031B2

(12) United States Patent
Hori et al.

(10) Patent No.: US 7,890,031 B2
(45) Date of Patent: Feb. 15, 2011

(54) DEVELOPING DEVICE AND PROCESS CARTRIDGE USED IN IMAGE FORMING APPARATUS

(75) Inventors: Eisuke Hori, Tokyo (JP); Hideki Kimura, Kanagawa (JP); Takuya Suganuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 301 days.

(21) Appl. No.: 12/188,549

(22) Filed: Aug. 8, 2008

(65) Prior Publication Data

US 2009/0047036 A1 Feb. 19, 2009

(30) Foreign Application Priority Data

Aug. 10, 2007 (JP) ..... 2007-208812
Dec. 4, 2007 (JP) ..... 2007-313531

(51) Int. Cl.
*G03G 15/08* (2006.01)

(52) U.S. Cl. ..... 399/281; 399/284

(58) Field of Classification Search ..... 399/111, 399/260, 279, 281, 284
See application file for complete search history.

(56) References Cited

U.S. PATENT DOCUMENTS 4,748,472 A * 5/1988 Mukai et al. ..... 399/283
4,836,135 A * 6/1989 Kohyama et al. ..... 399/281
5,369,478 A * 11/1994 Kobayashi et al. ..... 399/236
5,794,109 A * 8/1998 Ota et al. ..... 399/286
6,826,381 B2 11/2004 Muramatsu et al.
6,937,835 B2 * 8/2005 Okamoto ..... 399/284
7,043,182 B2 5/2006 Sakai et al.
7,228,093 B2 6/2007 Sakai et al.
7,272,342 B2 9/2007 Nagashima et al.
7,362,992 B2 * 4/2008 Nakasone et al. ..... 399/284
7,639,973 B2 * 12/2009 Sano et al. ..... 399/281
7,664,439 B2 * 2/2010 Sugiura ..... 399/267
2005/0031374 A1 2/2005 Nagashima et al.
2006/0029435 A1 2/2006 Kasai et al.

(Continued)

FOREIGN PATENT DOCUMENTS

JP 9-68912 3/1997

(Continued)

OTHER PUBLICATIONS

U.S. Appl. No. 12/015,787, filed Jan. 17, 2008, Eisuke Hori, et al.

*Primary Examiner*—Robert Beatty
(74) *Attorney, Agent, or Firm*—Oblon, Spivak, McClelland, Maier & Neustadt, L.L.P.

(57) ABSTRACT

The invention provides a developing device, a process cartridge and an image forming apparatus that allow preventing abrupt variations in toner charge on a developing roller, caused by intrusion, into a nip, of toner accumulated above a regulating member of the developing device. A developing device using a one-component developer includes: a supply roller to which one-component developer is replenished, by natural motion, from a developer storing section. The bottom of the developing device is of a size that allows the supply roller to rotate. The developing device further comprises a filling member for filling a space above the regulating member, in order to prevent the toner located above the regulating member from intruding into a nip formed between the supply roller and a developing roller.

18 Claims, 15 Drawing Sheets

U.S. PATENT DOCUMENTS

| | | | |
|---|---|---|---|
| 2007/0104516 | A1 | 5/2007 | Katoh et al. |
| 2008/0013982 | A1 | 1/2008 | Kimura |
| 2008/0025743 | A1 | 1/2008 | Hori |
| 2008/0175626 | A1 | 7/2008 | Murayama et al. |

FOREIGN PATENT DOCUMENTS

| | | | | |
|---|---|---|---|---|
| JP | 2001194883 | A | * | 7/2001 |
| JP | 2003-5487 | | | 1/2003 |

* cited by examiner

DEVELOPING DEVICE AND PROCESS CARTRIDGE USED IN IMAGE FORMING APPARATUS

BACKGROUND OF THE INVENTION

1. Field of the Invention

The present invention relates to a an image forming apparatus such as copier, a printer, and a fax machine, and more particularly to a developing device and a process cartridge used in an image forming apparatus.

2. Description of the Related Art

In known conventional one-component developer devices, for instance as disclosed in Japanese Patent No. 3320954, non-magnetic or magnetic toner (developer) stored in a container is supplied to a developing roller (developer carrier) by means of a toner supply member (roller) made of, for instance, foamed polyurethane or the like, and an elastic member such as a metal thin plate or the like is pressed and brought into contact with the developing roller (developer carrier) to homogenize thereby the toner on the developing roller (developer carrier) and develop an electrostatic latent image formed on a photosensitive member (image carrier).

In such developing devices, toner is scraped by a doctor blade. Herein, repeated passes over the doctor blade promotes eventual deterioration of the toner. When the toner, which is spread as a uniform thin film on the developing roller, is not consumed in the image, it returns again into the developing device. A problem in such devices is that friction at the scraping portion (pressing portion) of the toner supply member is substantial, which accelerates degradation of the toner (impairing, for instance, toner chargeability).

In recent years color image forming apparatuses have become widespread in the wake of the growing share of color documents in the office. These color image forming apparatuses include apparatuses that comprise four photosensitive drums in tandem. Four sets of image forming mechanisms, having each respective image forming functions, are built into the image forming apparatus. Developer images (toner images) of a respective color are formed on the four photosensitive drums, as image carriers, using a powdery one-component yellow, magenta, cyan or black developer (toner). The developer images are then sequentially transferred onto one sheet of a transfer material, to obtain a color image.

In conventional developing devices, however, the toner charging portion, the toner layer forming portion and the developer storage portion are disposed side by side (for instance, as disclosed in Japanese Patent No. 3320954). Such developing devices are thus difficult to make smaller, which is a serious drawback, in particular, for reducing the size of a color image forming apparatus comprising a plurality of such developing devices.

Therefore, size reduction has been realized by using an elongated developing device, as disclosed in, for instance, Japanese Patent Application Laid-open No. 2003-5487 (FIG. 7). In such an elongated developing device, toner is supplied as needed, sinking downwards on account of it own weight, to a developing roller, positioned below the developing device, that consumes the toner. At the lower portion of the device, toner that has become degraded by passing through the above-described friction portions is mixed with non-degraded toner that occasionally sinks from a storage section above. The various toner flows are mixed herein through the action of rotating members such as the developing roller, the supply roller and so forth, as a result of which there occur no sudden toner changes.

By contrast, toner accumulates without mixing in portions where flow is non-existent on account of remoteness from rotating bodies, among other factors. Virtually non-degraded toner accumulates, for instance, above the doctor blade, where the toner has nowhere to go and is substantially beyond the influence of rotating members. When the life of the device is drawing to its close and a certain amount of toner is consumed in the device, the own weight of toner above the doctor blade causes the accumulated toner to sink. Toner from that portion, which is virtually unmixed with degraded toner, may penetrate directly into the nip of the elastic member and become charged on the developing roller. The device deteriorates gradually as its life wears on, and toner charge on the developing roller changes gradually as well. In that situation, however, the intrusion of toner accumulated above the doctor gives rise to the problem of abrupt variations in toner charge on the developing roller. In particular, when the developer is a one-component developer, which unlike a two-component developer has no magnetic carrier, the behavior of toner, as the developer, inside the developing device becomes reflected on the images.

SUMMARY OF THE INVENTION

In the light of the above problems, it is an object of the present invention to provide a developing device and a process cartridge capable of preventing the occurrence of abrupt changes in toner charge on a developing roller, which arise from penetration, into the nip formed by a supply roller and a developing roller, of toner accumulating above a regulating member, in a developing device using a one-component developer, and to provide an image forming apparatus using the developing device and the process cartridge.

In aspect of the present invention, a developing device uses a one-component developer and comprises a developer carrier that is rotatably provided; a developer supply member that is rotatably provided in contact with the developer carrier; a developer storing section above the developer supply member; and a regulating member, pressing against the developer carrier, for homogenizing toner on the developer carrier. One-component developer is replenished to the developer supply member by natural motion from the developer storing section, and the bottom of the developing device is of a size that allows the developer supply member to rotate. The developing device further comprises a filling member for filling a space above the regulating member, in order to prevent toner located above the toner-homogenizing regulating member from intruding into a nip formed between the developer carrier and the developer supply member.

In another aspect of the present invention, a process cartridge is detachably mountable on an image forming apparatus and integrally supports at least an image carrier and a developing device. The developing device comprises a developer carrier that is rotatably provided; a developer supply member that is rotatably provided in contact with the developer carrier; a developer storing section above the developer supply member; and a regulating member, pressing against the developer carrier, for homogenizing toner on the developer carrier. One-component developer is replenished to the developer supply member by natural motion from the developer storing section, and the bottom of the developing device is of a size that allows the developer supply member to rotate. The developing device further comprises a filling member for filling a space above the regulating member, in order to prevent toner located above the toner-homogenizing regulating member from intruding into a nip formed between the developer carrier and the developer supply member.

In another aspect of the present invention, an image forming apparatus comprises an image carrier for forming a latent image; a charging device for uniformly charging the surface of the image carrier; an exposure device for exposing the surface of the charged image carrier, and writing a latent image thereon, on the basis of image data; a developing device for supplying toner to the latent image formed on the surface of the image carrier, to develop a visible image; a transfer device for transferring the visible image on the surface of the image carrier to a transfer material, directly or after transfer to an intermediate transfer body; and a fixing device for fixing the toner image on the transfer material. The developing device comprises a developer carrier that is rotatably provided; a developer supply member that is rotatably provided in contact with the developer carrier; a developer storing section above the developer supply member; and a regulating member, pressing against the developer carrier, for homogenizing toner on the developer carrier. One-component developer is replenished to the developer supply member by natural motion from the developer storing section, and the bottom of the developing device is of a size that allows the developer supply member to rotate. The developing device further comprises a filling member for filling a space above the regulating member, in order to prevent toner located above the toner-homogenizing regulating member from intruding into a nip formed between the developer carrier and the developer supply member.

In another aspect of the present invention, a developing device uses a one-component developer and comprises a developer carrier that is rotatably provided; a developer supply member that is rotatably provided in contact with the developer carrier; a developer storing section above the developer supply member; and a regulating member, pressing against the developer carrier, for homogenizing toner on the developer carrier. One-component developer is replenished to the developer supply member by natural motion from the developer storing section, and the bottom of the developing device is of a size that allows the developer supply member to rotate. The gap between the outer contour of the developer supply member and the bottom wall face of the developing device is not greater than 0.5 mm. The developing device further comprises separating member for separating the developer from the developer supply member. In the developing device, the separating member is not provided upstream in a rotation direction beyond a separating member boundary line being a straight line drawn, from the center of rotation of the developer supply member, to a separating member boundary point, which is a point shifted by 1.0 mm upstream in the rotation direction of the developer supply member, along the outer contour of the developer supply member, from a developer separation point. The developer separation point is the most upstream position, relative to the rotation of the developer supply member, within a portion of the separating member in which the separating member is in contact with the developer supply member. The developing device further comprises a developer stirrer that is rotatably provided, wherein a distance between a separation position at which the developer is separated from the developer supply member by the separating member, and the outer contour of the stirrer, is not greater than 6.0 mm.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(s)

Figure 1:
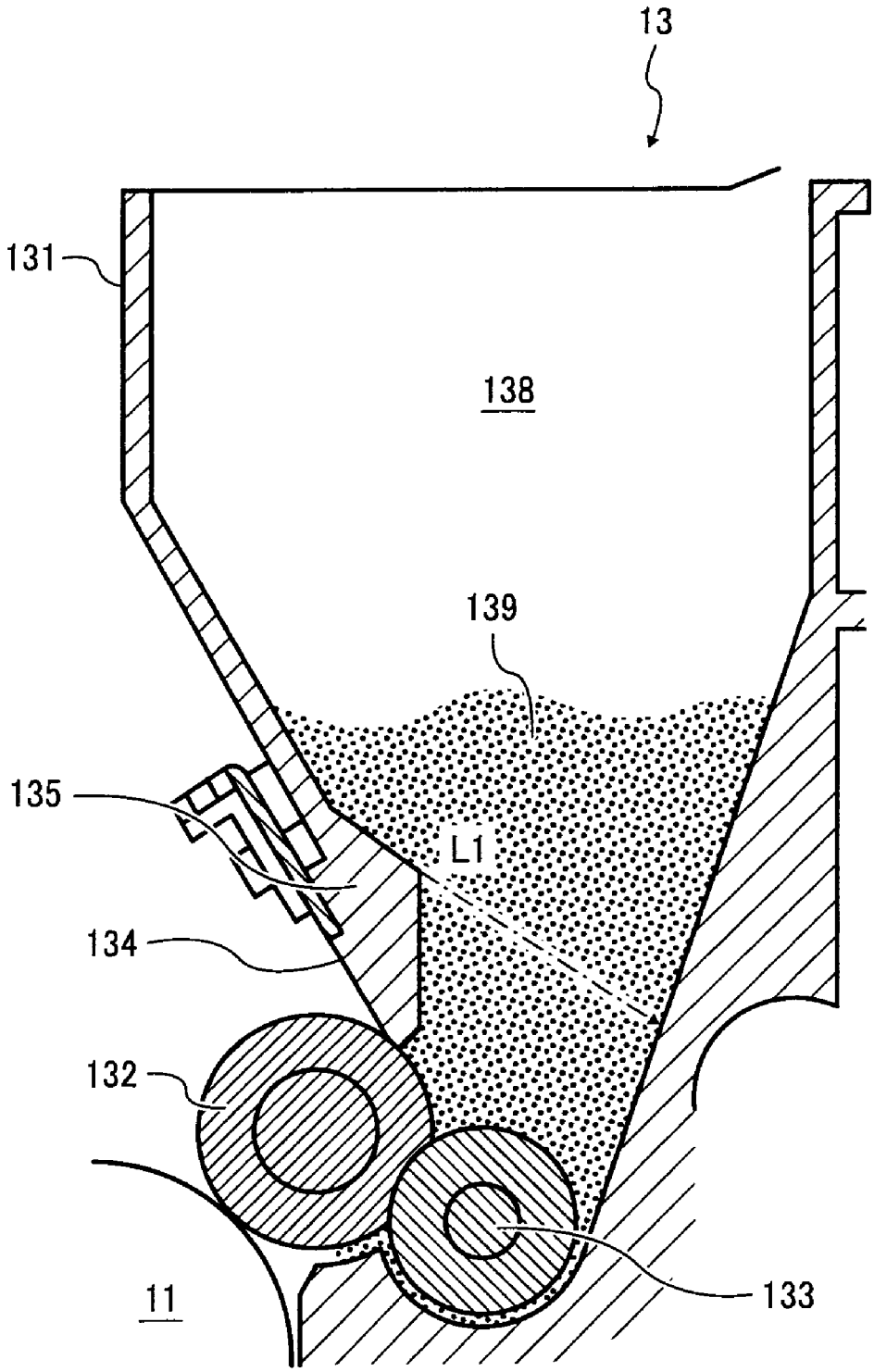
FIGS. 1 and 2 are diagrams illustrating schematically the constitution a developing device according to an embodiment of the present invention.

As illustrated in FIG. 1, a developing device 13 in a first embodiment of the present invention comprises a developing device housing 131 forming the developing device 13; a developer storing section 138, inside the developing device 13, being a space for storing a developer 139; a developing roller 132 for developing toner of the developing device 13 in an electrostatic latent image on the surface of an image carrier (photosensitive member) 11; a supply roller 133 for supplying toner of the developer storing section 138 to the developing roller 132; and a regulating member 134 for regulating the extent of the toner layer, formed on the developing roller 132, that is transported to the developing nip. The developer storing section 138 comprises a stirrer 136 for preventing the toner from forming cavities and from forming aggregates on account of its own weight.

To reduce the size of the developing device 13, the latter is made slimmer by providing the elongated developer storing section 138 on the upper portion of the developer charging portion and the developer layer forming portion. Thereby, the developer in the developer storing section 138 is naturally replenished, on account of its own weight, towards the supply roller 133 at the bottom of the developing device 13. The bottom of the developing device 13, moreover, has a gap only large enough so that the supply roller 133 can rotate, to supply thereby the replenished toner to the developing roller 132. If the developer is a one-component developer, there is no need for mixing the developer with a magnetic carrier and stirring the mixture, and hence there is no need for any space beyond the space taken up by developer transport and movement.

In such a configuration, where the developer supply direction is the direction of gravity, the developer supply amount varies depending on the developer storage capacity. Herein, it is difficult to supply developer stably, which is likely to result in developing defects such as fogging or the like arising from excessive uncharged developer, and/or in image defects such as image density variations or the like. The trend in recent years towards smaller-size toner particles, on account of ever more demanding image quality requirements, has exacerbated the tendency of toner to form aggregates. When the device is not used for some time, the toner in the developing device 13 aggregates on account of its own weight, so that, during use, only toner at the immediate vicinity of the supply roller 133 and the developing roller 132 is used, giving rise to the so-called "cavity formation" phenomenon. The resulting defective supply of toner leads to problems such as lower density and blurring/patchiness.

Therefore, in order to prevent the toner at the upper portion of the regulating member 134, which homogenizes the toner on the developing roller 132, from intruding into the nip formed between the developing roller 132 and the developer supply roller 133, the developing device 13 is provided with a filling member 135 for filling and/or blocking the space above the regulating member 134, as illustrated in FIG. 1. The filling member 135 takes up thus the space above the regulating member 134, as illustrated in FIG. 1, as a result of which toner sinking naturally along the developing device housing 131 does not penetrate directly into the nip between the developing roller 132 and the supply roller 133. Even when toner is consumed, non-degraded toner is transported as a result directly to the regulating member 134, so that toner charge does not vary abruptly on the developing roller 132.

Preferably, a line prolonged from the upper side L1 of the filling member 135 does not intersect the supply roller 133, but strikes the developing device housing 131 at an opposite side. The above configuration allows preventing toner intrusion, and even in case of toner intrusion, allows preventing toner from penetrating directly into the nip between the developing roller 132 and the supply roller 133.

In the developing device 13 there is provided a pressure reducing member 135*b* for preventing the pressure of the developer in the storing portion from acting on the regulating member 134. The pressure reducing member 135*b* is formed integrally with the filling member 135.

Figure 2:
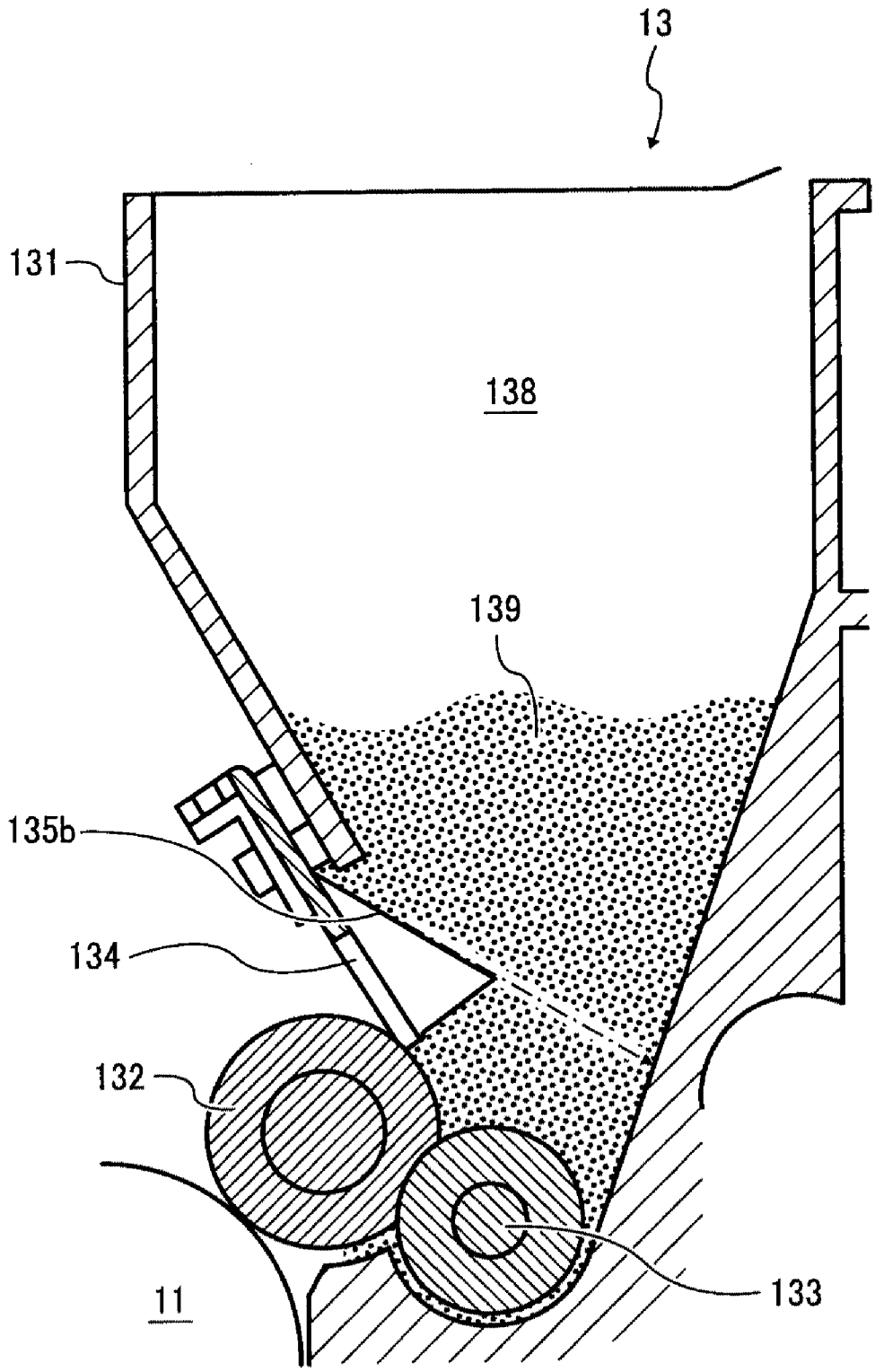

As illustrated in FIG. 2, the weight of the toner in the developing device 13, which bears down on the regulating member 134, is prevented from causing aggregates to form in the vicinity of the regulating member 134. However, toner in the region flanked by the regulating member 134 and the pressure reducing member 135*b* flows with more difficulty, which favors abrupt changes of toner charge on the developing roller 132. The pressure reducing member 135*b* is thus integrally provided with a member that takes up the space above the regulating member 134. Even when toner is consumed, therefore, non-degraded toner does not penetrate directly into the regulating member 134, and thus there occur no abrupt variations in toner charge on the developing roller 132. This can be achieved, moreover, in an inexpensive way.

To prevent the weight of the toner of the developer storing section 138 from bearing on the regulating member 134, the pressure reducing member 135*b* may be shaped as a plate-like member or in the same way as the filling member 135.

Therefore, the pressure reducing member 135*b* and the regulating member 134 delimit an empty inner space. In the absence of the pressure reducing member 135*b*, the toner tends to fill that empty space, on account of its own weight, whereby the toner may accumulate or aggregate therein. For an enhanced effect, the pressure reducing member 135*b* is combined with the filling member 135.

Preferably, a line prolonged from the upper side L1 of the filling member 135 does not intersect the supply roller 133, but strikes the developing device housing 131 at an opposite side. The above configuration allows preventing toner intrusion, and even in case of toner intrusion, allows preventing toner from penetrating directly into the nip between the developing roller 132 and the supply roller 133.

Figure 3:
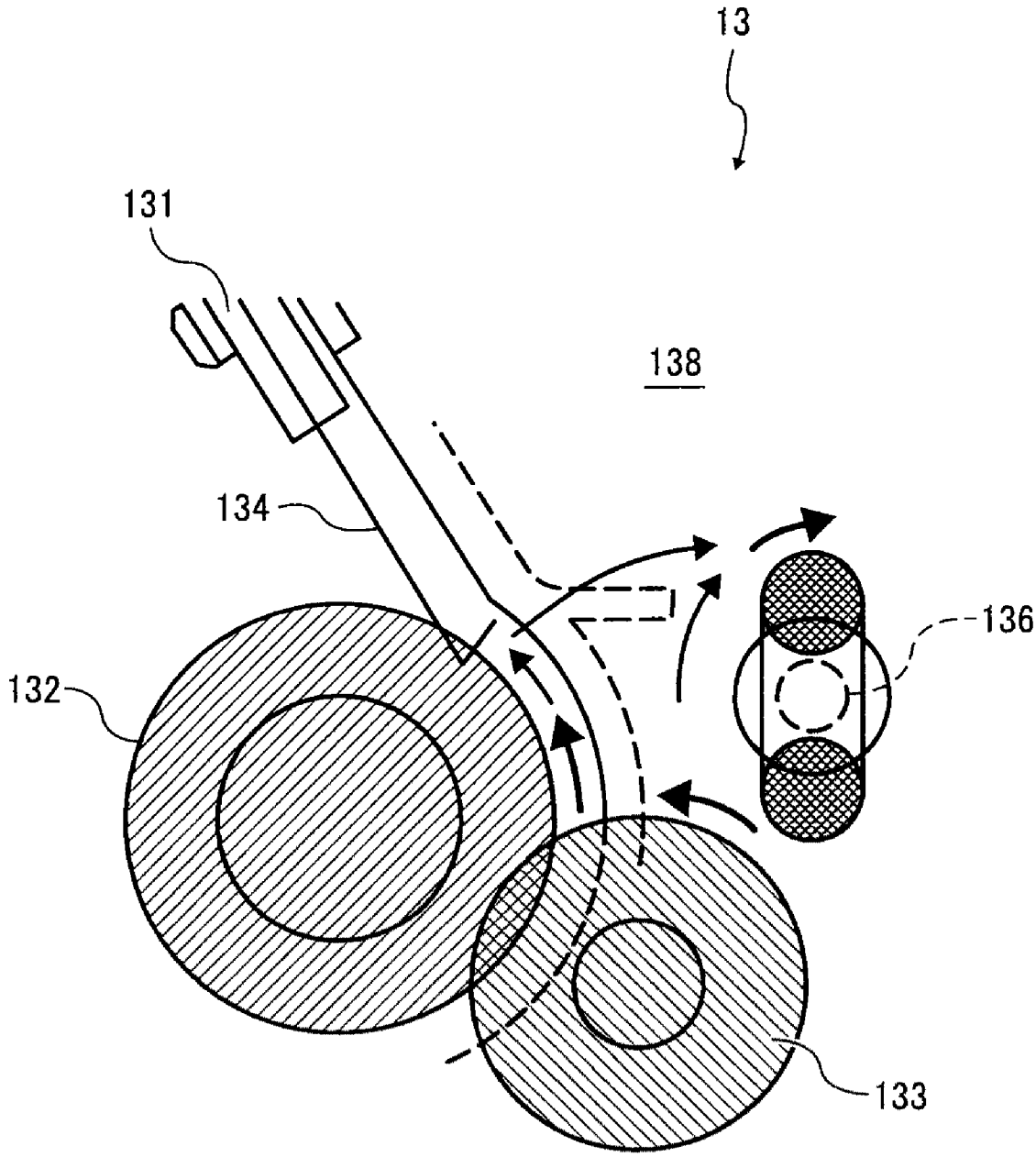
FIG. 3 PRIOR ART
FIG. 3 is a schematic diagram illustrating toner flow in the vicinity of a regulating member in a conventional developing device.
Figure 4:
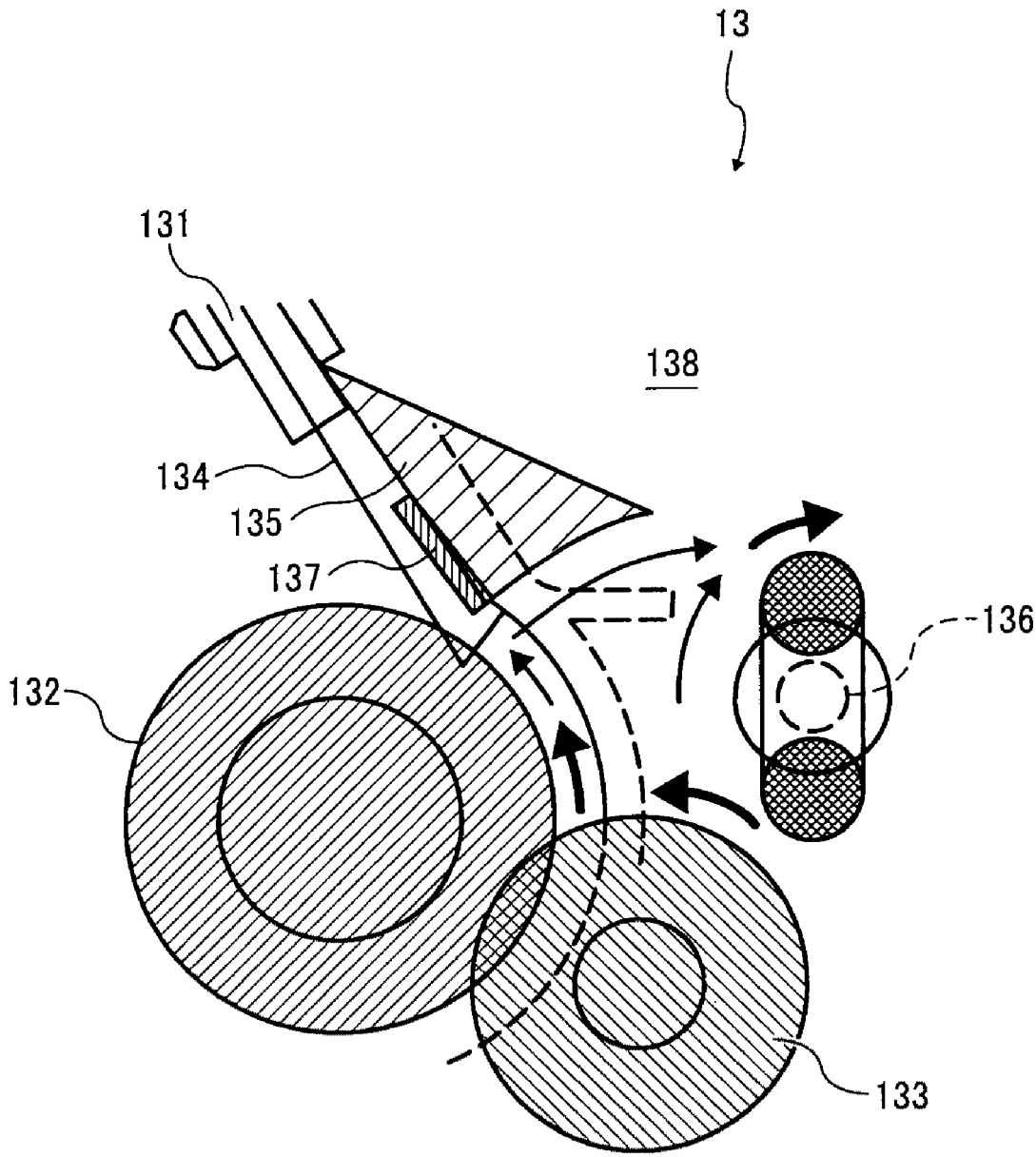
FIG. 4 is a schematic diagram illustrating toner flow in a regulating member in the developing device of the embodiment.

In the developing device 13, the filling member 135 does not hamper the flow of one-component developer that is recovered from the regulating member 134 into the developer storing section 138. The flow of toner in the vicinity of the regulating member 134 in a conventional developing device will be explained with reference to FIG. 3, while the flow of toner in the vicinity of the regulating member 134 in the present developing device is explained with reference to FIG. 4. With a view to preventing abrupt changes of toner charge on the developing roller 132, toner is preferably caused to flow in such a manner that degraded toner and non-degraded toner are well mixed. As illustrated in FIGS. 3 and 4, toner is fed into the regulating member 134 as a result of the flow created by the supply roller 133. The thin-layer toner passes through the nip, whereupon excess toner is scraped and made to return upstream along the bent angle of the regulating member 134. As illustrated in FIG. 4, a filling member is provided in the upper space of the regulating member 134, outside the range of flow of the above-described toner (at a position not obstructing the flow). Even when toner is consumed, therefore, non-degraded toner does not penetrate directly into the regulating member 134, and thus there occur no abrupt variations in toner charge on the developing roller 132, and no impairment of toner agitation at normal times. An elastic member 137 is provided in the filling member 135. The elastic member 137 uses an elastomer such as foamed polyurethane or the like. The filling member 135 and the pressure reducing member 135*b* comprise rigid bodies, and the regulating member 134 for filling up the space is also a rigid body. Hence it is difficult to ensure that the space is filled up with perfect sealing, since toner can accumulate in the smallest gaps. For this reason, the elastic member 137 is provided between the filling member 135, the regulating member 134 and so forth, comprising rigid bodies, to ensure complete sealing and preventing toner from accumulating.

Figure 5:
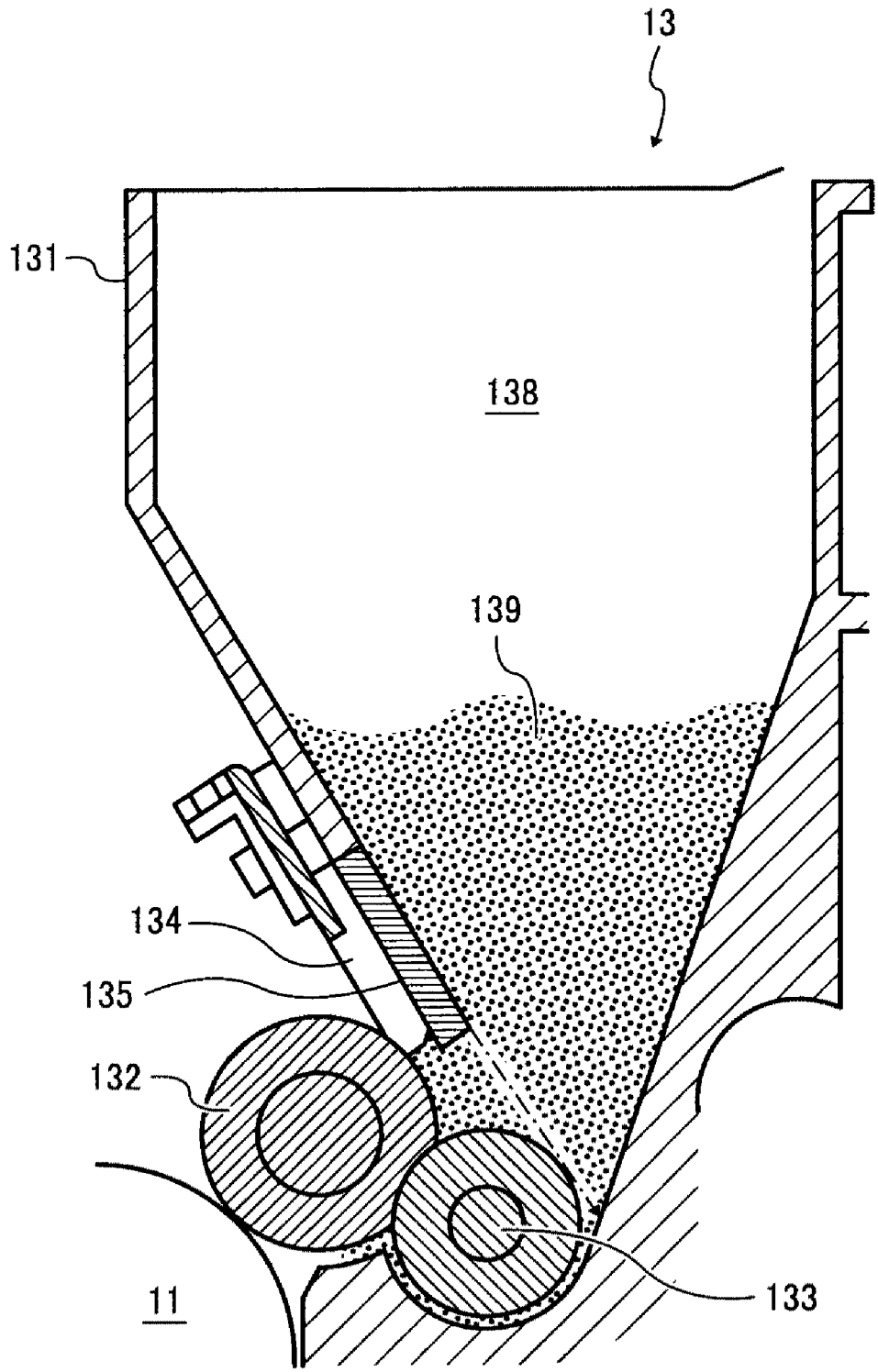
FIG. 5 is a diagram illustrating schematically the constitution of a developing device according to another embodiment of the present invention.

In the present developing device 13, moreover, the filling member 135 and the developing device housing 131 are formed integrally as a single unit. As shown in FIG. 5, when the filling member 135 is provided in the developing device 13, some space is lost in the developer storing section 138, and hence less toner can be stored therein. Therefore, the developing device housing 131 is molded extending up to the position above the regulating member 134, so as to form an integral body with the filling member 135. By filling up thus the portion above the regulating member 134, pressure derived from the weight of toner is prevented from bearing on the regulating member 134. Preferably, a line prolonged from the upper side L1 of the filling member 135 does not intersect the supply roller 133, but strikes the developing device housing 131 at an opposite side. The above configuration allows preventing toner intrusion, and even in case of toner intrusion, allows preventing toner from intruding directly into the nip between the developing roller 132 and the supply roller 133.

Figure 6:
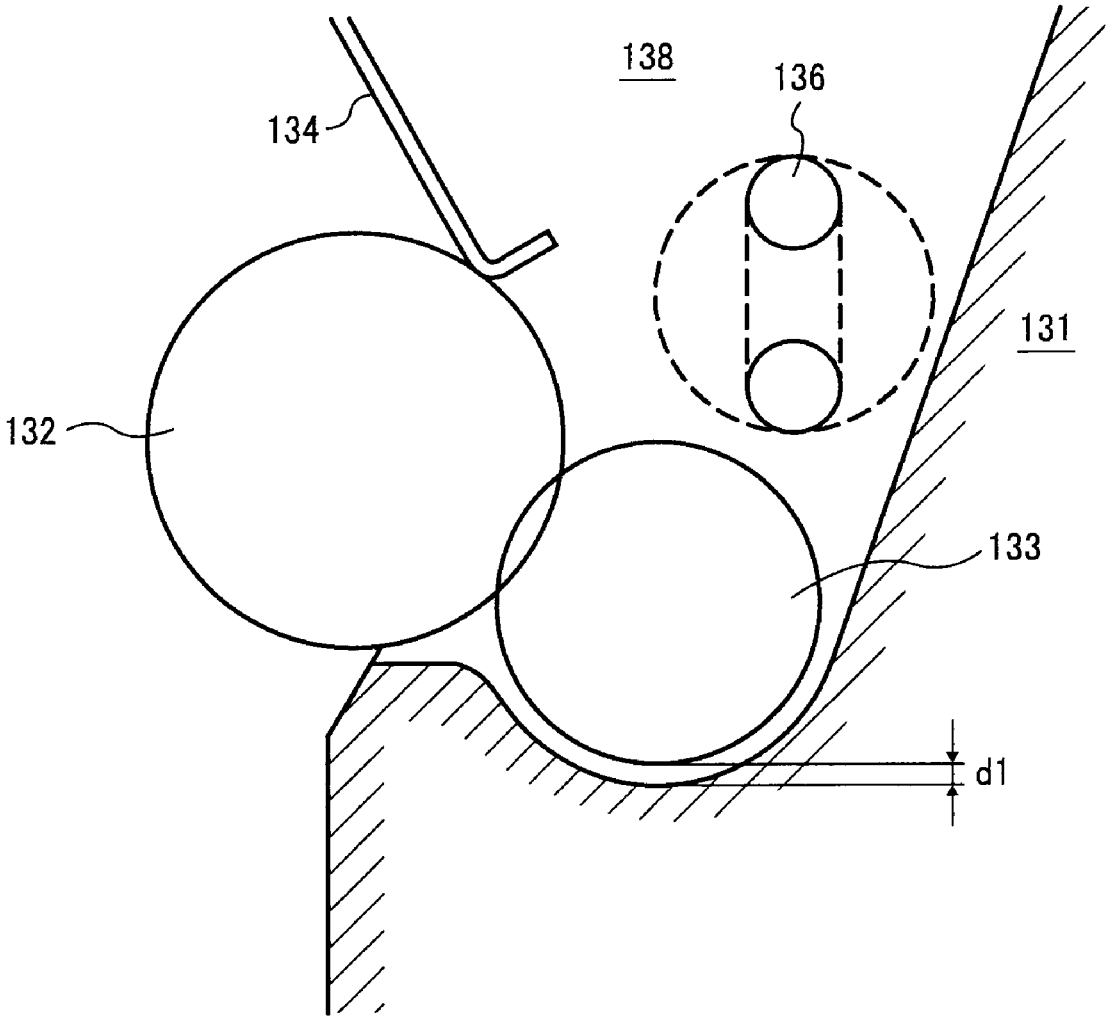
FIG. 6 is a diagram illustrating schematically the constitution of a relevant portion of the developing device.

In the developing device 13 according to another embodiment of the present invention, a gap d1 between the outer contour of the supply roller 133 and the bottom wall face of the developing device housing 131 of the developing device 13 is no greater than 0.5 mm, as illustrated in FIG. 6. The toner supplied to the developing roller 132 forms a thin layer at the nip portion between the regulating member 134 and the developing roller 132. Within the toner formed as a thin layer, the toner not used for developing is stripped from the developing roller 132 by the supply roller 133 at the nip portion between the developing roller 132 and the supply roller 133, and is transported up to the vicinity of an agitator 3 as a result of the rotation of the supply roller 133. The toner in the developing device 13 is mixed herein with the toner supplied to the developing roller 132 but not used for developing, which is brought up to the vicinity of the agitator 3 after having been stripped from the developing roller 132 by the supply roller 133. The mixed toner is conveyed again up to the developing roller 132, along the supply roller 133, to be supplied to the developing roller 132 at the nip portion between the developing roller 132 and the supply roller 133. Developing is carried out by repeating this cycle. Claim 1 prescribes a distance no greater than 0.5 mm between the outer contour of the supply roller 133 and the bottom wall face of the housing 131 of the developing device 13. This distance is represented by the gap d1 in FIG. 6 between the outer contour of the supply roller 133 and the bottom wall face of the housing 131 of the developing device 13. When this distance is large, toner accumulates between the supply roller 133 and the bottom wall face of the housing 131 of the developing device 13, or moves in a direction opposite to the rotation direction of the supply roller 133. When the gap d1 is kept no greater than 0.5 mm, toner moves along the rotation direction of the supply roller 133, and circulates efficiently within the developing device 13, in order to prevent a decline in image quality over time.

In quality engineering experiments, toner agitation was tested taking the distance between the outer contour of the supply roller 133 and the face of the housing 131 of the developing device 13 as a control factor (0.5 mm, 1.0 mm and 1.5 mm marks), and taking toner type and toner pressure as error factors.

Figure 7:
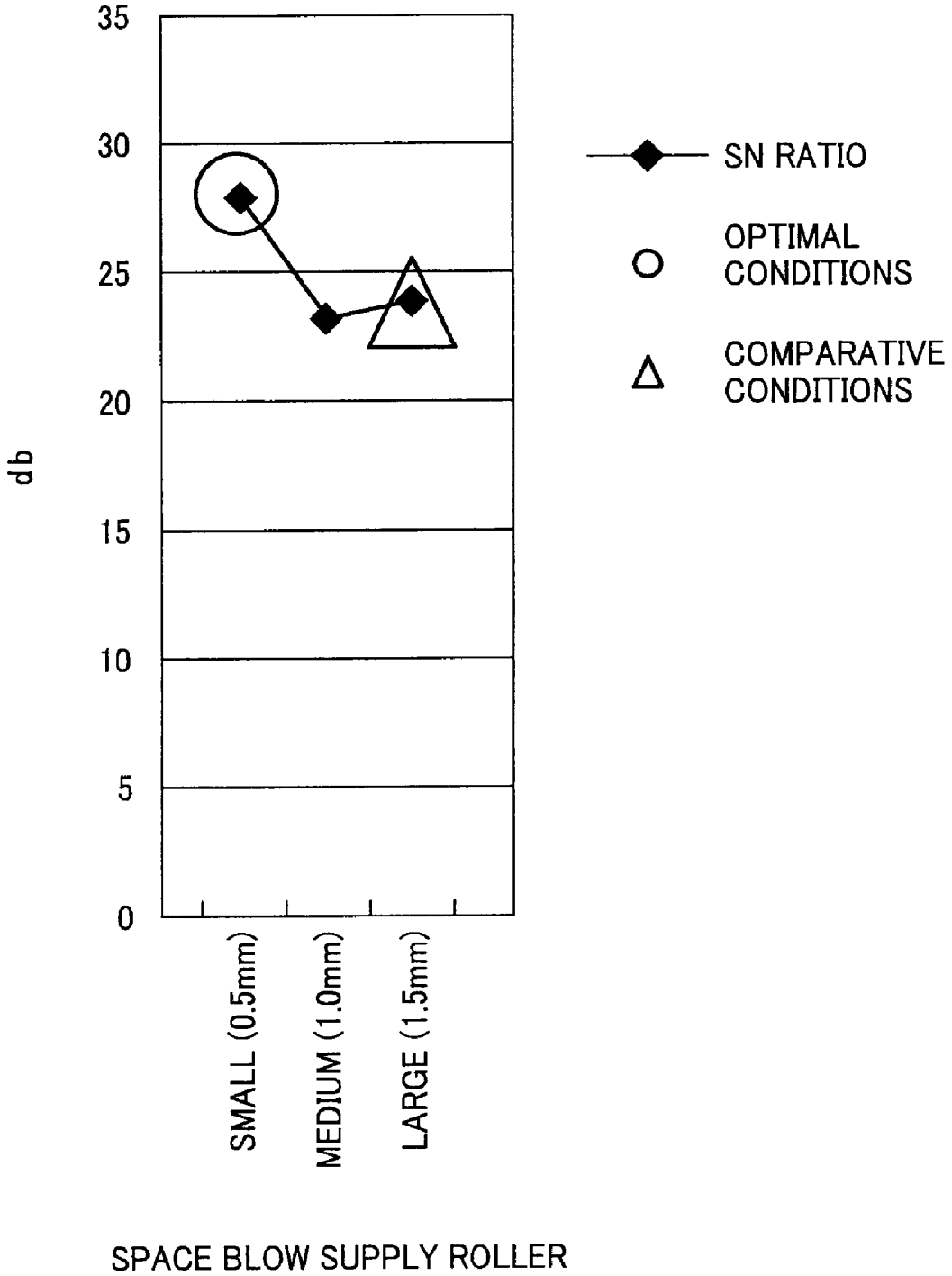
FIG. 7 is a diagram illustrating stability of toner turnover on a developing roller.

FIG. 7 is a graph illustrating stability of toner turnover on the developing roller.

Stability is greater for a gap d1 of 0.5 mm than for 1.0 mm and 1.5 mm. When the gap d1 is 1.5 mm, and toner flow is observed between the supply roller 133 and the wall face of the housing 131 of the developing device 13, it turns out that toner does flow along the supply roller 133 in the vicinity of the developing roller 132, but flows in a direction opposite to the rotation of the supply roller 133 in the vicinity of the wall face. As a result, toner turnover on the developing roller 132 becomes unstable. The results of the experiments support the finding to the effect that toner flow in a direction opposite to the rotation of the supply roller 133 can be reduced by narrowing the distance between the outer contour of the supply roller 133 and the face of the housing 131 of the developing device 13.

Figure 8A:
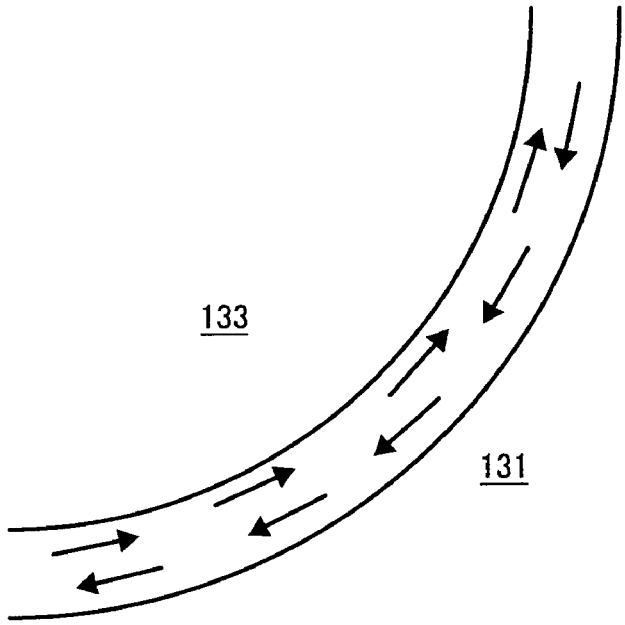
FIGS. 8A and 8B are diagrams illustrating toner flow in a gap between a supply roller and a bottom wall face of a housing of the developing device.
Figure 8B:
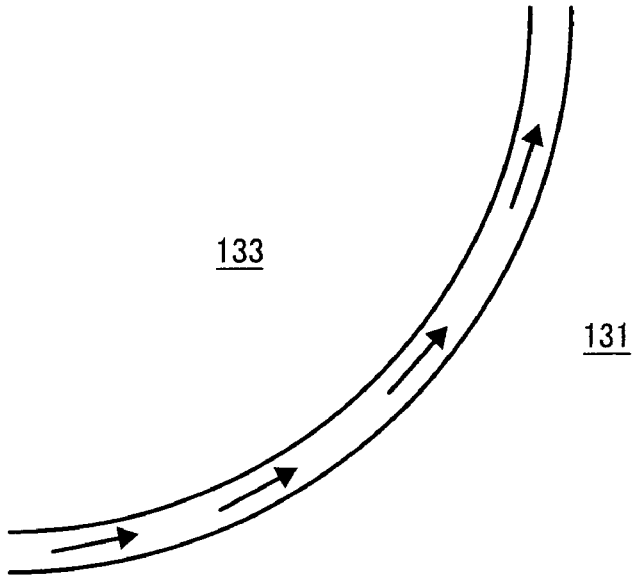
Figure 9:
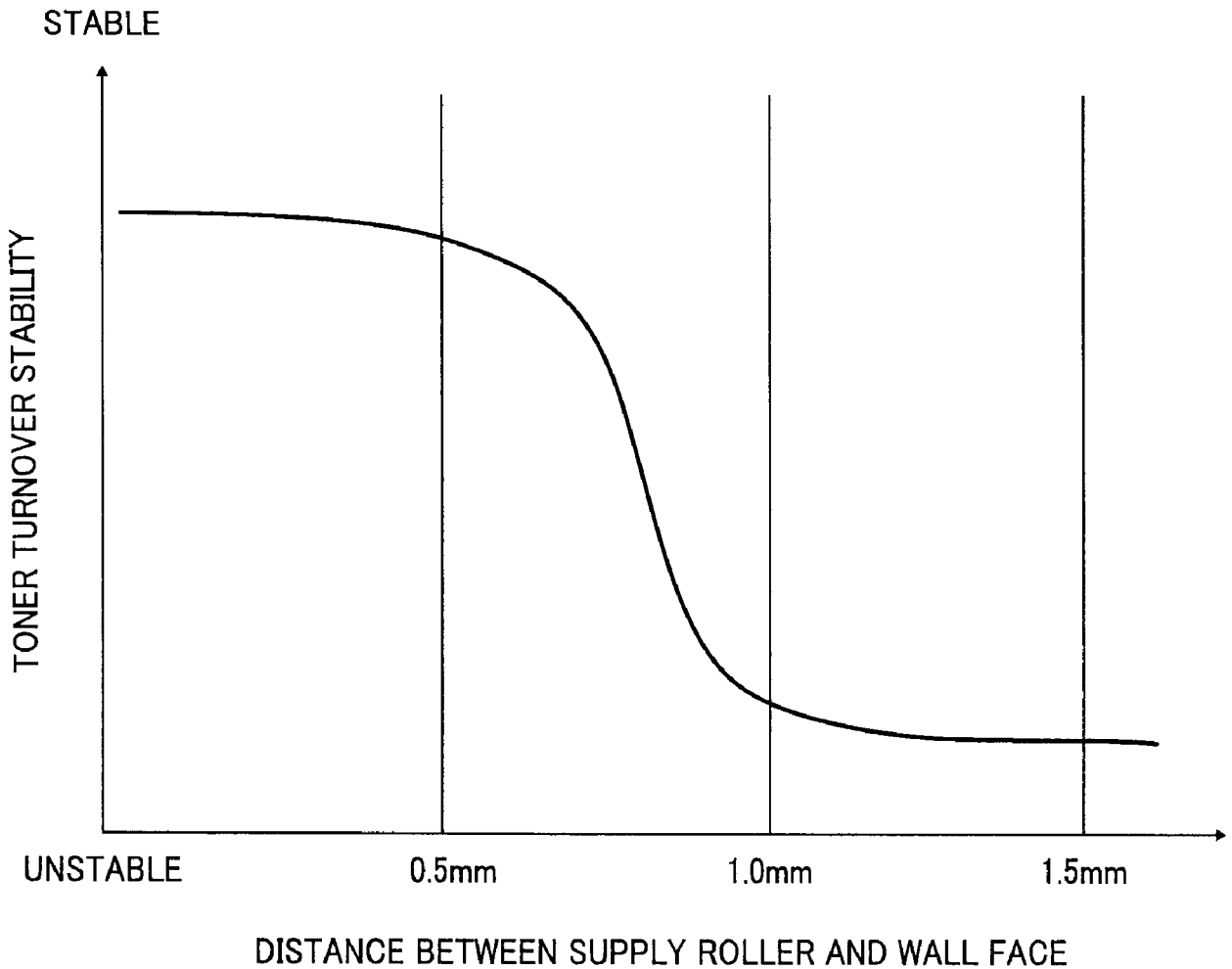
FIG. 9 is a graph illustrating schematically the relationship between toner turnover stability and the gap between the supply roller and the bottom wall face of the housing of the developing device.

FIGS. 8A and 8B illustrate toner flow in the gap between the supply roller and the bottom wall face of the housing of the developing device. FIG. 9 is a graph illustrating schematically the relationship between toner turnover stability and the gap between the bottom wall face of the housing of the developing device and the supply roller. In FIG. 8A, when the gap d1 between the supply roller 133 and the wall face of the housing 131 of the developing device 13 is wide, toner flow becomes wide as well, flowing in both directions in a complex pattern. When the gap d1 is narrow, toner flows simply along a narrow path, in one direction only.

Therefore, the relationship between stability of toner turnover on the developing roller 132 and the distance between the wall face of the developing device 13 and the supply roller 133 are as illustrated in FIGS. 8A, 8B and 9 when that distance is 0.5 mm. Therefore, toner agitation is least affected by toner type and toner pressure when that distance is no greater than 0.5 mm.

The present developing device comprises a member (hereinafter, "separating member" 140 for stripping developer from the supply roller 133.

Figure 10:
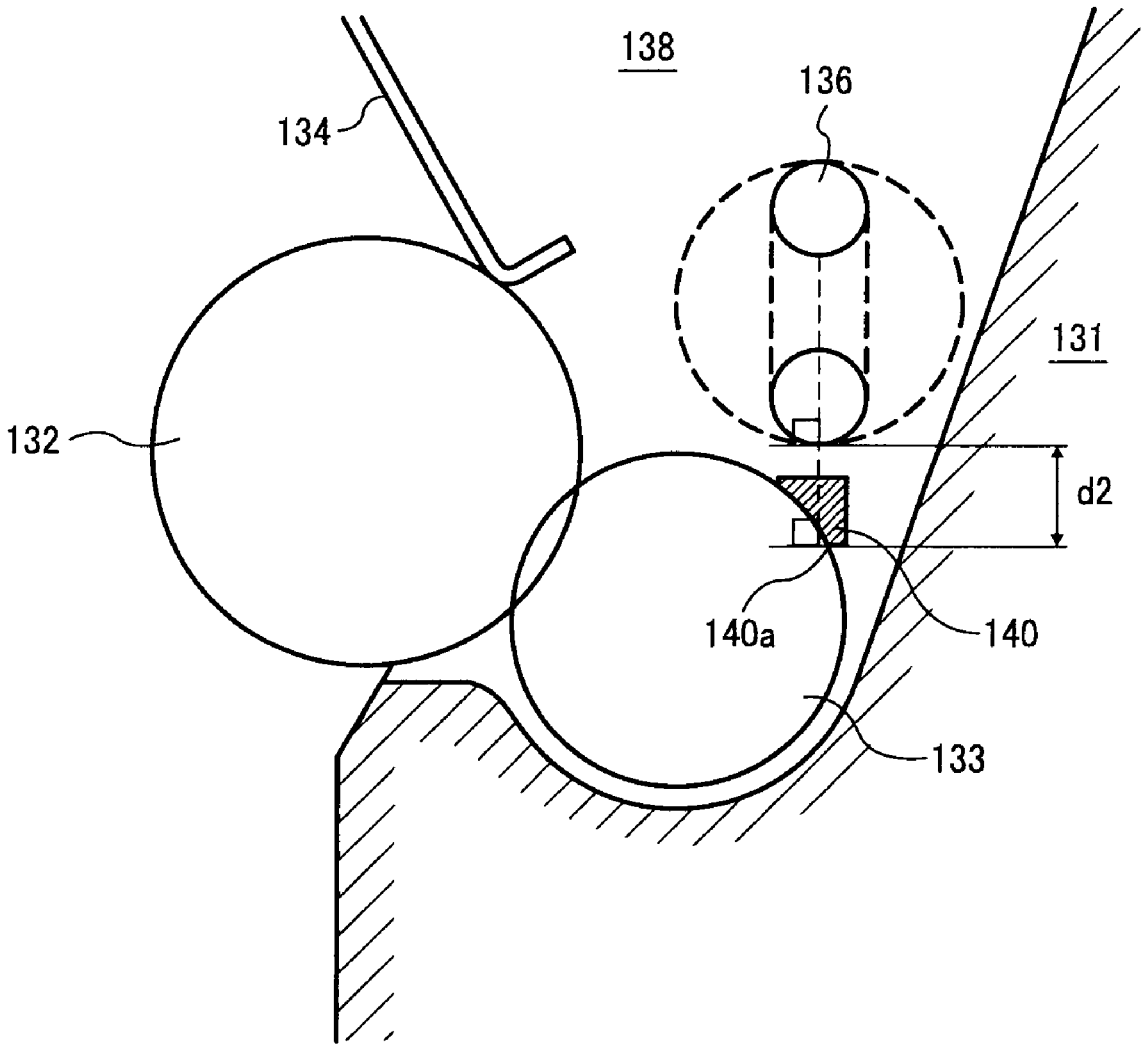
FIG. 10 is a diagram illustrating schematically the constitution of the developing device of the present invention, having provided a separating member.

FIG. 10 illustrates the constitution of a developing device comprising such a separating member. In addition to prescribing a distance of no more than 0.5 mm between the outer contour of the supply roller 133 and the bottom wall face of the housing 131 of the developing device 13, the developing device 13 is provided with the separating member 140 for stripping toner from the supply roller 133, as illustrated in FIG. 10. The gap d1 in FIG. 6 represents the distance between the outer contour of the supply roller 133 and the bottom wall face of the housing 131 of the developing device 13. When this distance is large, toner accumulates between the supply roller 133 and the bottom wall face of the housing 131 of the developing device 13, or moves in a direction opposite to the rotation direction of the supply roller 133. When the gap d1 is kept no greater than 0.5 mm, toner moves along the rotation direction of the supply roller 133, and circulates efficiently within the developing device 13. Moreover, providing the separating member 140 for stripping toner from the supply roller 133 has the effect of mixing more toner in the developing device 13 than is the case when no separating member is provided. Variability of toner characteristic values in the developing device 13 is reduced as a result, with a view to preventing a decline in image quality over time.

The position of the toner separating member 140 in the developing device 13 of the present invention is a prescribed position.

Figure 11:
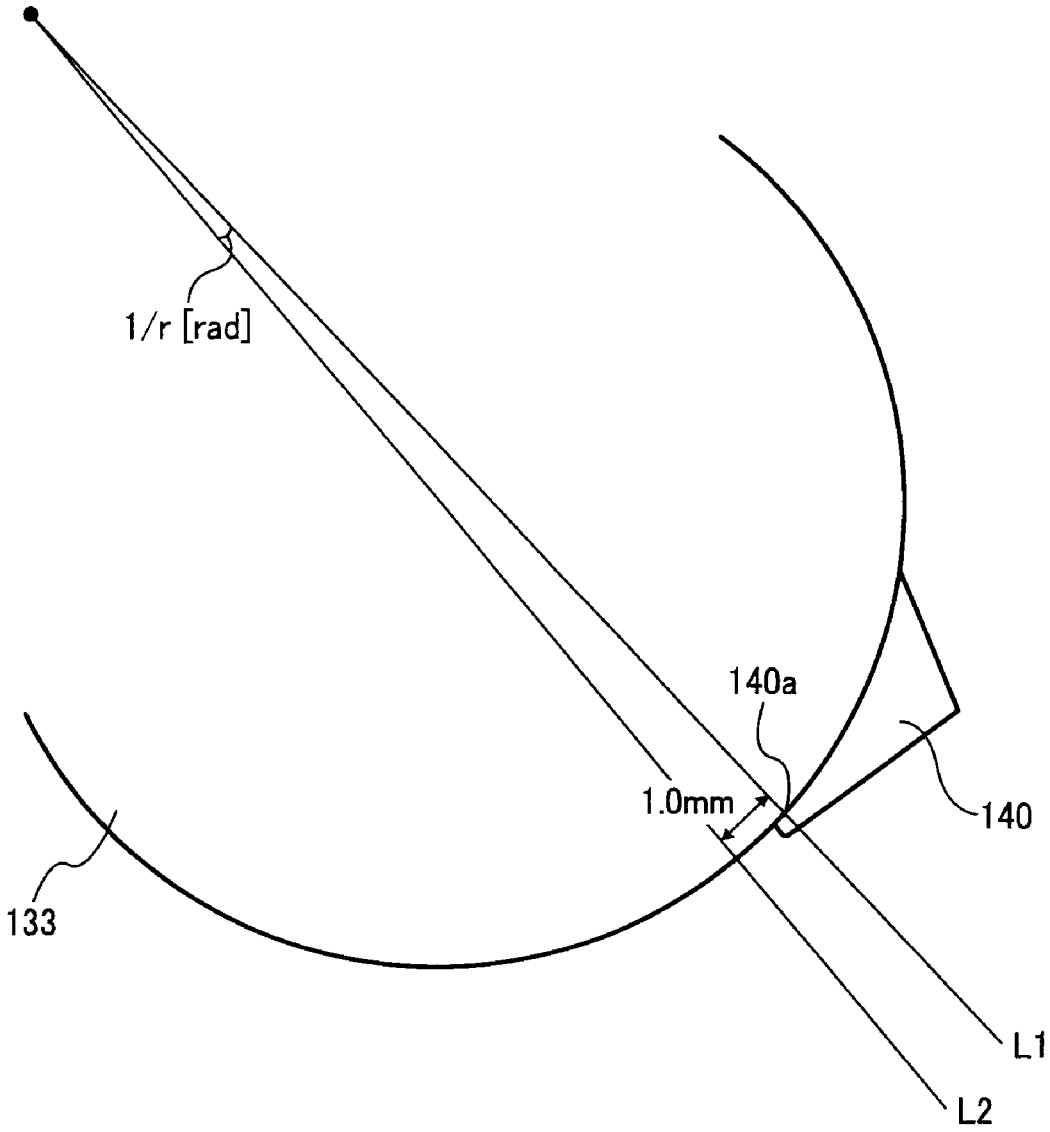
FIG. 11 is a diagram illustrating the position of a toner separating member in the developing device of the present invention.

FIG. 11 illustrates the position of the toner separating member in the developing device of the present invention. Specifically, the separating member 140 is not present by 1.0 mm or more upstream, relative to the supply roller 133, from a developer separation point 140*a*. Using the separating member 140 having such a shape has the effect of smoothing toner flow in the vicinity of the separation point 140*a*. The separated toner is prevented thereby from accumulating, which enhances toner circulation performance. An instance of 1.0 mm or more upstream of the separation point 140*a* is concretely delimited by straight lines. The separation point 140*a* is defined as the most upstream position, within the contact portion of the separating member 140 and the supply roller 133, relative to the rotation of the supply roller 133. L1 is a straight line extending from the center of rotation of the supply roller 133 to the separation point 140*a*. Further, L2 is a straight line rotated by 1/(supply roller 133 radius) rad in the rotation upstream direction of the supply roller 133, taking L as the center of rotation of the supply roller 133. The units used are in mm. The length of the arc delimited by L1 and L2 on the outer contour of the supply roller 133 is 1 mm. The region upstream of the straight line L2 in the rotation direction is defined as the region upstream from the separation point 140*a* by 1.0 mm or more.

Figure 12:
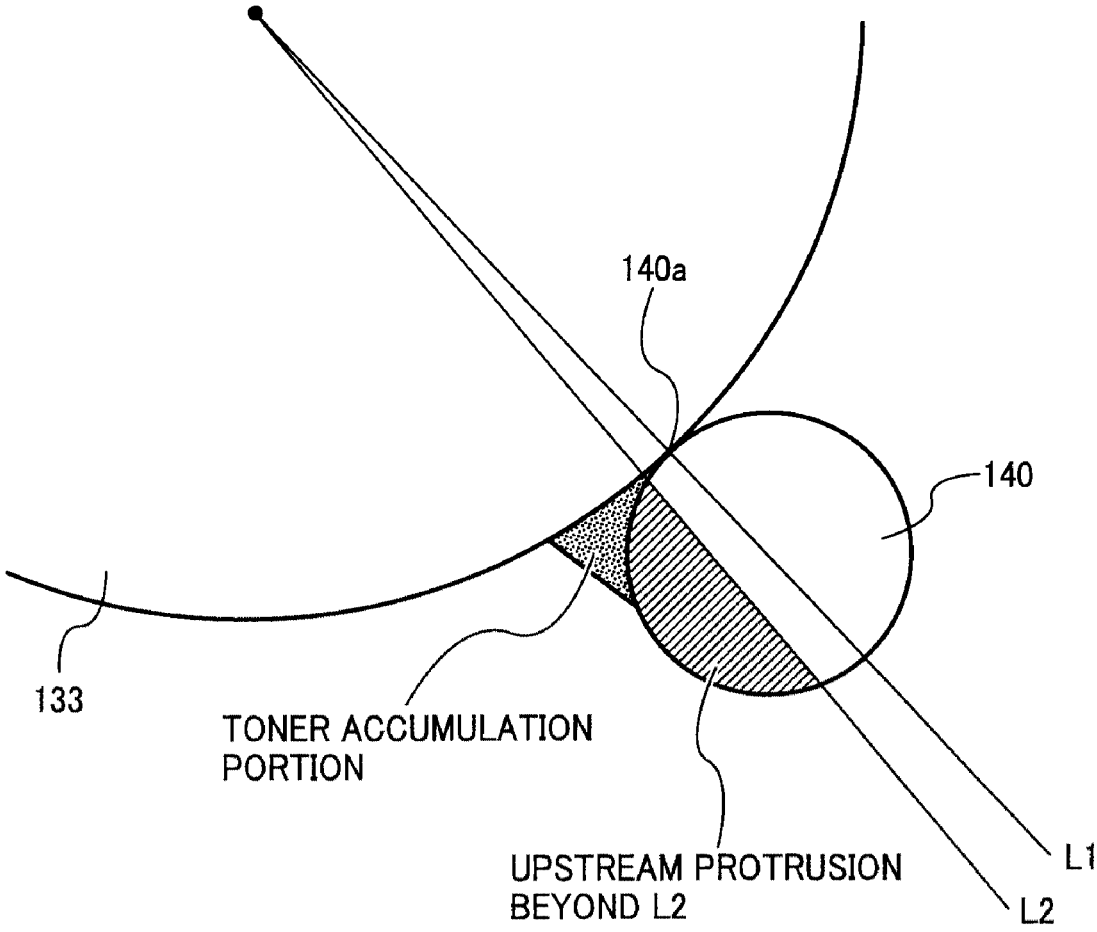
FIG. 12 is a diagram illustrating schematically toner accumulation when the separating member has a cylindrical shape.
Figure 13:
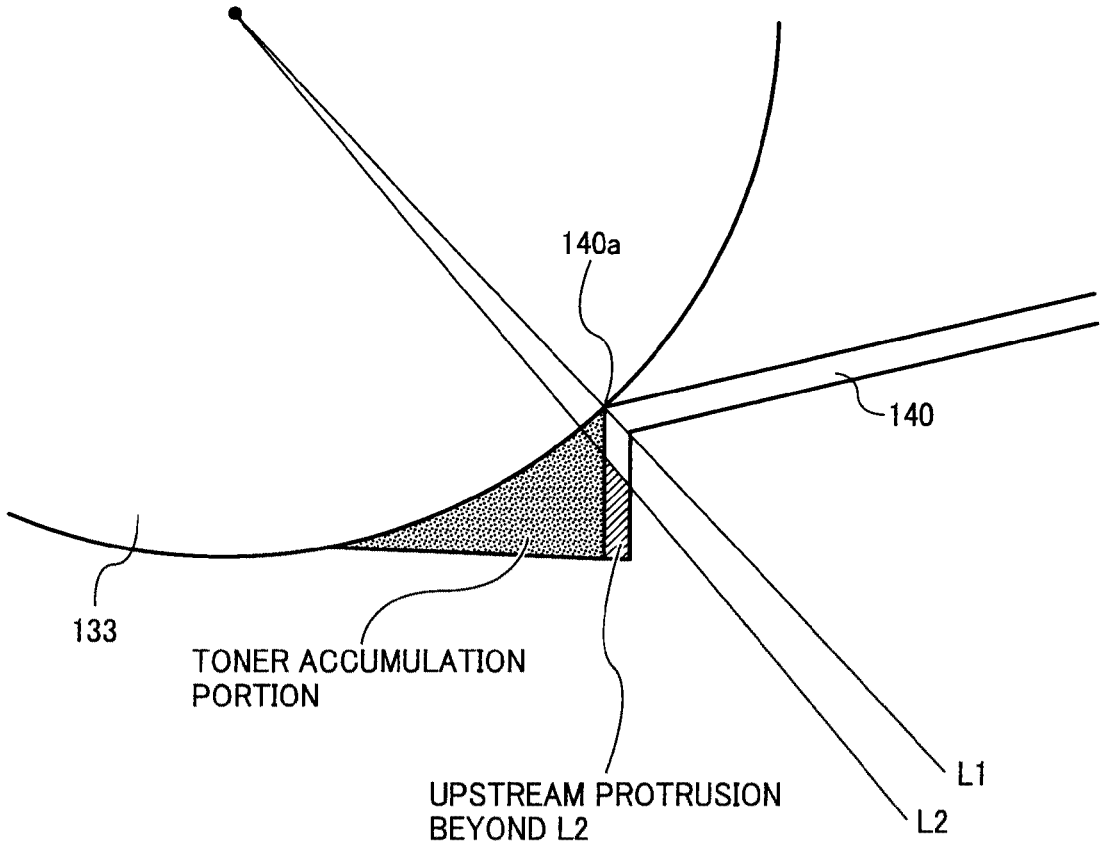
FIG. 13 is a diagram illustrating schematically toner accumulation when the separating member has a blade-like shape.

FIG. 12 illustrates schematically toner accumulation when the separating member is cylindrical, and FIG. 13 when the separating member has a blade-like shape. In these examples, toner does not flow smoothly in the vicinity of the separation point 140*a*, and becomes accumulated there.

Meanwhile, the stirrer 136 for stirring the developer is rotationally provided, and the distance between the outer contour of the rotatably provided developer stirrer 136 and the separation position 140*a* at which developer is separated from the supply roller 133 by the separating member 140, is no greater than 6.0 mm. Such a distance allows mixing efficiently the separated toner and the toner in the developing device 13. The gap d2 illustrated in FIG. 10 denotes the distance between the outer contour of the stirrer 136 and the separation point 140*a* of the separating member 140. When the stirrer 136 is at a position removed from the separation point 140*a*, the stirrer moves only by being pushed from behind by the separated toner. In that case, toner in the developing device 13 and toner separated from the supply roller 133 cannot be mixed efficiently. In the present invention, mixing proceeds efficiently by keeping a narrow distance between the stirrer 136 and the separation point 140*a*.

The toner used in the developing device 13 according to the present invention is explained next.

Preferably, the toner used in the present invention has a volume average particle diameter (Dv) of 3.0 to 8.0 μm, and the ratio (Dv/Dn) between the volume average particle diameter (Dv) and a number average particle diameter (Dn) ranges from 1.00 to 1.40. Toner having a smaller particle size is advantageous in that it yields high-quality images with high resolution. Conventionally, however, when the average particle is made smaller, toner tends to become less fluid, giving rise to cavity formation in the developer storing section 138. When such cavities collapse, the amount of toner on the developing roller 132 changes considerably, as does image quality, giving rise in particular to abnormal images with substantial fogging. When using the developing device 13 of the present invention, therefore, the amount of toner in the developer storing section 138 is not affected by the small particle size of the toner, and thus identical images can be obtained. When using a one-component toner, and the volume average particle diameter is smaller than 3.0 μm, it becomes impossible to prevent filming of toner on the developing roller 132, or fusion of the toner onto the regulating member 134 that makes the toner into a thin layer. On the other hand, when the volume average particle diameter exceeds 8.0 μm, it becomes difficult to obtain high-quality images with high resolution.

Also, when Dv/Dn exceeds 1.40, the proportion of microparticles increases, and it becomes impossible to prevent filming of toner on the developing roller 132, or fusion of the toner onto the regulating member 134 that makes the toner into a thin layer.

The average particle diameter and particle distribution of the toner can be measured using an instrument COULTER COUNTER TA-II or COULTER MULTISIZER (by Coulter Corp.).

The measuring method is as follows. Firstly, 0.1 to 5 ml of a surfactant (preferably alkylbenzene sulfonate) are added, as a dispersant, to 100 to 150 ml of an aqueous electrolyte solution. The electrolyte solution is ISOTON R-II (by Coulter Scientific Japan Inc.), obtained using a 1% NaCl aqueous solution prepared with first grade sodium chloride. Next, 2 to 20 mg of measurement sample are added to the electrolyte solution, to suspend the measurement sample in the electrolyte solution, and then the suspension is dispersed in an ultrasonic disperser for about 1 to 3 minutes. Using the above measurement instruments, the volume and number of toner particles in the above samples are measured for different channels, with an aperture of 100 μm, to calculate the volume distribution and number distribution of the toner.

The channels are 13 channels, as follows: 2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

The toner of the present invention has preferably a shape factor SF-1 from 100 to 180 and a shape factor SF-2 from 100 to 180. More preferably, the toner has a SF-1 from 110 to 170, yet more preferably from 120 to 160, and most preferably from 130 to 150. More preferably, the toner has a SF-2 from 110 to 170, yet more preferably from 120 to 160, and most preferably from 130 to 150.

Figure 14A:
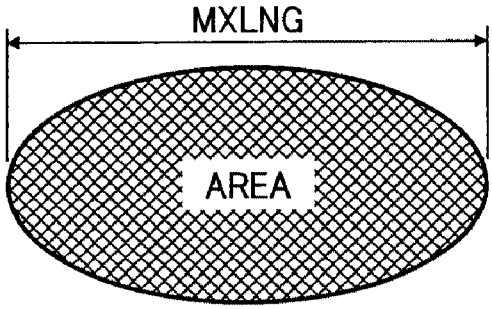
FIGS. 14A and 14B are diagrams illustrating schematically toner shapes, for explaining shape factors SF-1 and SF-2.
Figure 14B:
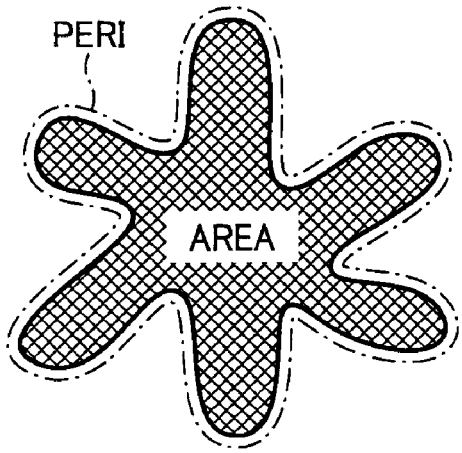

FIGS. 14A and 14B are diagrams representing schematically toner shapes, for explaining the shape factors SF-1 and SF-2. FIG. 14A is a diagram for explaining the shape factor SF-1 and FIG. 14B is a diagram for explaining the shape factor SF-2

The shape factor SF-1 is indicative of the degree of roundness of the toner shape, as expressed by equation (1), in which the square of the maximum length MXLNG of the toner image in a two-dimensional projection thereof is divided by the surface area, AREA, of the toner image, and then multiplied by 100 π/4.

Meanwhile, the factor SF-2 is indicative of the degree of unevenness of the toner shape, as expressed by equation (2), in which the square of the length of the periphery, PERI, of the toner image in a two-dimensional projection thereof is divided by the surface area, AREA, of the image, and then multiplied by 100 n/4.

$$SF\text{-}1=\{(MXLNG)^2/AREA\}\times(100\pi/4). \quad \text{Eq. (1)}$$

$$SF\text{-}2=\{(PERI)^2/AREA\}\times(100\pi/4). \quad \text{Eq. (2)}$$

When the value SF-1 is 100, the toner has a true spherical shape, while when the value SF-1 is greater than 100, the toner particles have an indefinite shape. When the value SF-2 is 100, the toner surface has no irregularities. A larger value of SF-2 corresponds to larger irregularities on the toner surface.

The shape factor SF-1 is determined by sampling 100 randomly selected images of toner particles that are imaged, magnified at 500 magnifications, using an electronic microscope (for instance, FE-SEM S-800, by Hitachi Ltd., likewise hereinafter), and by introducing the image information, via an interface, into an image analyzer, where the images are analyzed to calculate the shape factor SF-1 on the basis of Eq. (1). Examples of the image analyzer include, for instance, nexus NEW CUBE ver. 2.5 (by NEXUS Co., Ltd.) and LUZEX III (by Nicore Co., Ltd.) (likewise hereinafter).

The shape factor SF-2 is determined by sampling 50 randomly selected images of toner particles that are imaged, magnified at 3500 magnifications, using an electronic microscope, and by introducing the image information, via an interface, into an image analyzer, where the images are analyzed to calculate the shape factor SF-2 on the basis of Eq. (2).

When the shape factors SF-1 and SF-2 approach 100, i.e. when the toner shape approaches a perfect sphere, toner particles become likelier to form aggregates among them. Therefore, using the developing device 13 of the present invention allows preventing the occurrence of aggregates in the regulating member 134. When the toner shape factors SF-1 and SF-2 are rather large, on the other hand, cavities formed in the toner collapse more readily, thereby giving rise to substantial image changes derived from the amount of toner in the developer storing section 138. To balance these two tendencies, the shape factors SF-1 and SF-2 range preferably from 100 to 180, as a range within which image quality is not impaired.

The toner that can be used in the developing device 13 of the image forming apparatus 100 according to the present invention is, for instance, a toner prepared by performing, in an aqueous medium, a crosslinking and/or extension reaction in a toner material solution that contains, at least, a polyester prepolymer having a functional group containing a nitrogen atom, a polyester, a colorant and a releasing agent, dispersed in an organic solvent. A toner thus manufactured allows obtaining easily the above-described volume average particle diameter and shape factors.

The constituent materials of the toner and manufacturing method thereof are explained next.

(Modified Polyester)

The toner of the present invention comprises a modified polyester (i) as a binder resin. The modified polyester (i) denotes a polyester resin having a bonding group other than an ester bond in a polyester resin; or a polyester resin in which different resin components in the polyester are bonded through covalent bonding or ionic bonding. Specifically, the modified polyester denotes a polyester being modified by introducing a functional group such as an isocyanate group, which reacts with a carboxyl group or a hydroxyl group, at the termini of the polyester, with further reaction of the polyester with an active hydrogen-containing compound, to modify thereby the polyester termini.

Suitable modified polyester resins that can be used as the modified polyester (i) include, for instance, a urea-modified polyester or the like obtained by reacting a polyester prepolymer (A) having an isocyanate group with an amine (B). As the polyester prepolymer (A) having an isocyanate group, there can be used, for example, polyesters prepared by a method in which a polyester having active hydrogen groups, being a polycondensation product of a polyhydric alcohol (PO) and a polybasic carboxylic acid (PC), is reacted with a polyfunctional isocyanate (PIC). Suitable groups having an active hydrogen of the polyester include hydroxyl groups (alcoholic hydroxyl groups and phenolic hydroxyl groups), amino groups, carboxyl groups, mercapto group or the like. Among these groups, alcoholic hydroxyl groups are preferred.

The urea-modified polyester is prepared as follows.

As the polyhydric alcohol compound (PO) there can be used a dihydric alcohol (DIO) and a polyhydric alcohol (TO) higher than trihydric alcohol. A dihydric alcohol (DIO) alone or a mixture of a dihydric alcohol (DIO) with a small amount of polyhydric alcohol (TO) is preferably used. Specific examples of the dihydric alcohol (DIO) include alkylene glycols such as ethylene glycol, 1,2-propylene glycol, 1,3-propylene glycol, 1,4-butanediol, 1,6-hexanediol; alkylene ether glycols such as diethylene glycol, triethylene glycol, dipropylene glycol, polyethylene glycol, polypropylene glycol, polytetramethylene ether glycol; alicyclic diols such as 1,4-cyclohexane dimethanol, hydrogenated bisphenol A; bisphenols such as bisphenol A, bisphenol F, bisphenol S; adducts of the above-mentioned alicyclic diols with an alkylene oxide such as ethylene oxide, propylene oxide, butylenes oxide; and adducts of the above-mentioned bisphenols with an alkylene oxide such as ethylene oxide, propylene oxide, butylenes oxide or the like. Preferably used among the foregoing are alkylene oxide adducts of bisphenols and C2 to C12 alkylene glycols, in particular alkylene oxide adducts of bisphenols, used concomitantly with C2 to C12 alkylene glycols. Specific examples of the tri- or more polyhydric alcohol (TO) include, for instance, polyhydric aliphatic alcohols having 3 to 8 hydroxyl groups, such as glycerin, trimethylolethane, trimethylolpropane, pentaerythritol and sorbitol; phenol compounds having 3 or more hydroxyl groups such as trisphenol PA, phenol novolac and cresol novolac; and alkylene oxide adducts of the abovementioned phenol compounds having 3 or more hydroxyl groups.

The polybasic carboxylic acid (PC) may be a dicarboxylic acid (DIC), or a tri- or more polybasic carboxylic acid (TC). The use of a dicarboxylic acid (DIC) singly, or a mixture of a dicarboxylic acid (DIC) with a small amount of a tri- or more polybasic carboxylic acid (TC), is preferred. Examples of the dicarboxylic acid (DIC) include, for instance, alkyldicarboxylic acids such as succinic acid, adipic acid and sebacic acid; alkenylene dicarboxylic acids such as maleic acid and fumaric acid; and aromatic dicarboxylic acids such as phthalic acid, isophthalic acid, terephthalic acid, and naphthalene dicarboxylic acid. Preferred among the foregoing are C4 to C20 alkenylene dicarboxylic acids and C8 to C20 aromatic dicarboxylic acids. Preferred examples of the tri- or more polybasic carboxylic acid (TC) include C9 to C20 aromatic polybasic carboxylic acids such as trimellitic acid and pyromellitic acid. The polybasic carboxylic acids (PC) may be formed by reacting the above-described anhydrides or lower alkyl esters, such as methyl ester, ethyl ester and isopropyl ester, with the polyhydric alcohol (PO).

The ratio of polyhydric alcohol (PO) and polybasic carboxylic acid (PC), expressed as the ratio [OH]/[COOH] of the equivalents of hydroxyl groups [OH] to the equivalents carboxyl groups [COOH], ranges ordinarily from 2/1 to 1/1, preferably from 1.5/1 to 1/1, and more preferably from 1.3/1 to 1.02/1.

Examples of the polyfunctional isocyanate compound (PIC) include, for instance, aliphatic polyfunctional isocyanates such as tetramethylene diisocyanate, hexamethylene diisocyanate and 2,6-diisocyanate methylcaproate; alicyclic polyfunctional isocyanates such as isophorone diisocyanate, cyclohexylmethane diisocyanate; aromatic diisocyanates such as tolylene diisocyanate, diphenylmethane diisocyanate; araliphatic diisocyanates such as $\alpha,\alpha,\alpha',\alpha'$-tetramethylxylylene diisocyanate; isocyanurates; the abovementioned isocyanates blocked with phenol derivatives, oximes or caprolactams; and mixtures of two or more of the foregoing.

The ratio of the polyfunctional isocyanate compounds (PIC), which is represented by the ratio [NCO]/[OH] of the equivalents of isocyanate groups [NCO] to the equivalents hydroxyl groups [OH] of the polyester, ranges ordinarily from 5/1 to 1/1, preferably from 4/1 to 1.2/1, more preferably from 2.5/1 to 1.5/1. A [NCO]/[OH] ratio exceeding 5/1 tends to adversely affect low temperature fixability. A molar ratio of [NCO] smaller than 1 tends to reduce the urea content in the urea-modified polyester, and to adversely affect anti-hot offset properties.

The content of the polyfunctional isocyanate compound (PIC), as a constituent component of the isocyanate group-containing polyester prepolymer (A), ranges ordinarily from 0.5 to 40 wt %, preferably from 1 to 30 wt %, more preferably from 2 to 20 wt % relative to the isocyanate group-containing polyester prepolymer (A). A polyfunctional isocyanate compound content of less than 0.5% tends to adversely affect anti-hot offset properties and to preclude achieving simultaneously both low temperature fixabilty and heat-resisting storability. A polyfunctional isocyanate compound content beyond 40 wt % impairs low-temperature fixability.

The average number of isocyanate groups per molecule of the isocyanate group-containing polyester prepolymer (A) is ordinarily no smaller than 1, preferably 1.5 to 3, more preferably 1.8 to 2.5. Less than 1 isocyanate group per molecule results in a urea-modified polyester having a small molecular weight, which impairs the anti-hot offset properties of the toner.

Examples of the amine (B) that is reacted with the polyester prepolymer (A) include, for instance, diamines (B1), polyfunctional amines (B2) having three or more amino groups, amino alcohols (B3), amino mercaptans (B4), amino acids (B5), and amines (B6) in which the amino groups of (B1) to (B5) are blocked.

Specific examples of suitable diamines (B1) include aromatic diamines such as phenylenediamine, diethyltoluenediamine and 4,4'-diaminodiphenylmethane; alicyclic diamines such as 4,4'-diamino-3,3-dimethylcyclohexylmethane, diaminocyclohexane and isophoronediamine; and aliphatic diamines such as ethylenediamine, tetramethylenediamine and hexamethylenediamine. Examples of suitable polyfunctional amines (B2) having three or more amino groups include, for instance, diethylenetriamine and triethylenetetramine. Examples of suitable amino alcohols (B3) are ethanolamine and hydroxyethylaniline. Examples of suitable amino mercaptans (B4) include, for instance, aminoethylmercaptan and aminopropylmercaptan. Examples of suitable amino acids (B5) include, for instance, aminopropionic acid and aminocaproic acid. Suitable examples of the amines (B6) in which the amino groups of (B1) to (B5) are blocked include, for instance, ketimines formed by reacting the above-mentioned (B1) to (B5) amines with ketones such as acetone, methyl ethyl ketone and methyl isobutyl ketone, or oxazolidine compounds. Particularly preferred among the amines (B) are diamines (B1) either individually or in combination with a small amount of polyfunctional amines (B2).

The ratio of amines (B) relative to the isocyanate group-containing polyester prepolymer (A), which is represented by [NCO]/[NHx] of the equivalents of isocyanate groups [NCO] to the equivalents of amino groups [NHx] of the amine (B), ranges ordinarily from 1/2 to 2/1, preferably from 1.5/1 to 1/1.5, more preferably from 1.2/1 to 1/1.2. An [NCO]/[NHx] ratio above 2/1 or below 1/2 results in a lower molecular weight of the urea-modified polyester, which impairs the anti-hot offset properties of the toner.

The urea-modified polyester may contain urethane bonds as well as urea bonds. The molar ratio of urea bond content to urethane bond content ranges ordinarily from 100/0 to 10/90, preferably from 80/20 to 20/80, more preferably from 60/40 to 30/70. A molar ratio of urea bonds below 10% impairs the anti-hot offset properties of toner.

The modified polyester (i) used in the present invention may be prepared by a one-shot or prepolymer method. The weight-average molecular weight of the modified polyester (i) is ordinarily no smaller than 10,000, and ranges preferably from 20,000 to 10,000,000, more preferably from 30,000 to 1,000,000. The peak molecular weight ranges preferably from 1,000 to 10,000. A peak molecular weight below 1,000 hampers the extension reaction and reduces toner flexibility, impairing as a result the anti-hot offset properties of the toner. A peak molecular weight beyond 10,000 reduces fixability and exacerbates manufacturing problems during particle formation and crushing. When the modified polyester (i) is used in combination with a below-described non-modified polyester (ii), the number average molecular weight of the modified polyester (i) is not particularly limited, and may be a number-average molecular weight that allows easily achieving the above-described weight-average molecular weight. When the modified polyester (i) is used singly, the number-average molecular weight thereof is ordinarily no greater than 20,000, and ranges preferably from 1,000 to 10,000, more preferably 2,000 to 8,000. When the number-average molecular weight of the modified polyester exceeds 20,000, low-temperature fixability deteriorates, and glossiness is impaired when the toner is used in a full color apparatus.

In the cross-linking reaction and/or elongation reaction of the polyester prepolymer (A) with the amine (B) to prepare the modified polyester (i), a reaction stopper can be used, as the case may require, to adjust the molecular weight of the resulting urea-modified polyester. Specific examples of such reaction stoppers include, for instance, monoamines (e.g., diethyl amine, dibutyl amine, butyl amine and lauryl amine); and blocked amines (ketimine compounds) obtained by blocking the foregoing monoamines.

The molecular weight of the polymer to be formed can be measured by means of gel permeation chromatography (GPC).

(Unmodified Polyester)

The toner in the present invention can contain not only the above-described polyester (i), but also an unmodified polyester (ii), in combination with the polyester (i), as a binder resin component. By using a combination of modified polyester (i) with an unmodified polyester (ii), the low-temperature fixability of the toner can be improved, while glossiness can be improved as well when the toner is used in a full color apparatus. This concomitant use is thus preferable to using of the polyester (i) alone. Suitable unmodified polyesters (ii) include polycondensation products of a polyhydric alcohol (PO) with a polybasic carboxylic acid (PC) identical to the polyester components of the above-described polyester (i). Preferred examples of the polyhydric alcohol (PO) and a polybasic carboxylic acid (PC) are also identical to those of the polyester (i). Also, the polyester (ii) may be not only an unmodified polyester, but also a polyester modified with chemical bonds other than urea bonds, for instance a polyester modified with urethane bonds. When using a mixture of a modified polyester (i) with an unmodified polyester (ii), it is preferable that the foregoing be at least partially compatible, from the viewpoint of low-temperature fixability and hot offset resistance of the resulting toner. Accordingly, the polyester component (i) and (ii) have preferably a similar composition. When the modified polyester (i) contains an unmodified polyester (ii), the weight ratio of polyester (i) to (ii) when (ii) is present ranges ordinarily from 5/95 to 80/20, preferably from 5/95 to 30/70, more preferably from 5/95 to 25/75, and yet more preferably from 7/93 to 20/80. A weight ratio of polyester (i) of less than 0.5% tends to adversely affect anti-hot offset properties and to preclude achieving simultaneously both low temperature fixability and heat-resisting storability.

The peak molecular weight of the unmodified polyester (ii) ranges ordinarily from 1,000 to 10,000, preferably from 2,000 to 8,000, and more preferably from 2,000 to 5,000. When the peak molecular weight is below 1,000, the heat-resisting storability of the toner deteriorates, while low-temperature fixability becomes impaired when the peak molecular weight exceeds 10,000. Preferably, the hydroxyl value of the unmodified polyester (ii) is not lower than 5, and ranges preferably from 10 to 120, and in particular, from 20 to 80. A hydroxyl value below 5 tends to preclude achieving simultaneously low temperature fixability and heat-resisting storability. The acid value of the unmodified polyester (ii) ranges preferably from 1 to 5, more preferably form 2 to 4. When a wax having a high acid value is used as the wax, a low acid-acid value binder is used to impart chargeability and high volume resistivity, to better match toners that are used in two-component developers.

The glass transition temperature (Tg) of the binder resin ranges ordinarily from 35 to 70° C., preferably from 55 to 65°

C. When the glass transition temperature is below 35° C., heat-resisting storability is impaired, while low-temperature fixability is insufficient when the glass transition temperature exceeds 70° C. The urea-modified polyester appears readily on the surface of the obtained toner mother particles, and hence the toner of the present invention exhibits good heat-resisting storability, even with a low glass transition temperature, as compared with known polyester-based toners.

The glass transition temperature (Tg) can be measured using an instrument THERMOFLEX TG8110, by Rigaku, at a temperature rise rate of 10° C./min. The method for measuring the glass transition temperature is briefly outlined next.

As the measurement device for measuring the glass transition temperature there can be used the TG-DSC system TAS-100 by Rigaku. To perform a DSC measurement, specifically, a sample of about 10 mg is placed in an aluminum container, and the container is set on a holder unit, which is in turn set in an electrical furnace. Thereafter, the sample is heated from room temperature to 150° C. at a temperature rise rate of 10° C./min. The sample is left to stand at 150° C. for 10 minutes, whereafter the sample is cooled down to room temperature, and allowed to settle for 10 minutes. The sample is then heated again, under a nitrogen atmosphere, from room temperature to 150° C. at a temperature rise rate of 10° C./min for DSC measurement. The value of the glass transition temperature (Tg) is determined using an analysis system of the TAS-100 system, according to which the temperature is calculated on the basis of the contact point between a baseline and the tangent of the endothermic curve in the vicinity of the Tg.

(Colorant)

Any of pigments and dyes conventionally known can be employed as the colorant. When used as black toner in the developing device 13, however, the toner must comprise iron black. The toner may also comprise carbon black, for hue adjustment and electric resistance adjustment. The colorant may be, for example, carbon black, a Nigrosine dye, Naphthol Yellow S, Hansa Yellow (10G, 5G and G), cadmium yellow, yellow colored iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthracene Yellow BGL, isoindolinone yellow, red iron oxide, red lead, orange lead, cadmium red, cadmium mercury red, antimony orange, Permanent Red 4R, Para Red, Fire Red, Parachloroorthonitro aniline red, Lithol Fast Scarlet G, Brilliant Fast Scarlet, Brilliant Carmine BS, Permanent Red (F2R, F4R, FRL, FRLL and F4RH), Fast Scarlet VD, Vulkan Fast Rubine B, Brilliant Scarlet G, Lithol Rubine GX, Permanent F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake B, Rhodamine Lake Y, Alizarine Lake, Thioindigo red B, Thioindigo Maroon, Oil Red, quinacridone red, Pyrazolone Red, polyazo red, Chrome Vermilion, Benzidine Orange, perinone orange, Oil Orange, cobalt blue, cerulean blue, Alkali Blue Lake, Peacock Blue Lake, Victoria Blue lake, metal-free Phthalocyanine Blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide or lithopone. The content of colorant ranges ordinarily from 1 to 15 wt %, more preferably from 3 to 10 wt % of the toner.

The colorant can also be used in the form of a master batch, combined with a resin. Examples of resins used for master batch preparation, or that are kneaded with master batches include, for instance, styrene polymers and substituted styrene polymers such as polystyrene, poly-p-chlorostyrene and polyvinyltoluene; copolymers of the foregoing with vinyl compounds; as well as polymethyl methacrylate, polybutyl methacrylate, polyvinyl chloride, polyvinyl acetate, polyethylene, polypropylene, polyesters, epoxy resins, epoxy polyol resins, polyurethane, polyamide resins, polyvinyl butyral resins, polyacrylic resins, rosin, modified rosins, terpene resins, aliphatic or alicyclic hydrocarbon resins, aromatic petroleum resins, chlorinated paraffin, paraffin waxes or the like. These resins are used alone or in combination.

(Charge Control Agent)

Examples of the charge control agent that can be used include, for instance, known charge control agents such as Nigrosine dyes, triphenylmethane dyes, chromium-containing metal complex dyes, chelate pigments of molybdic acid, rhodamine dyes, alkoxyamines, quaternary ammonium salts (including fluorine-modified quaternary ammonium salts), alkylamides, phosphor or phosphor compounds, tungsten or tungsten compounds, fluorine-containing activators, metal salts of salicylic acid, and metal salts of salicylic acid derivatives or the like. Specific examples of the foregoing include, for instance, BONTRON® 03 (Nigrosine dye), BONTRON® P-51 (quaternary ammonium salt), BONTRON® S-34 (metal-containing azo dye), E-82 (metal complex of oxynaphthoic acid) E-84 (metal complex of salicylic acid), and E-89 (phenolic condensation product), by Orient Chemical Industries Co., Ltd.; TP-302 and TP-415 (molybdenum complex of quaternary ammonium salt), by Hodogaya Chemical Co., Ltd.; COPY CHARGE® PSY VP2038 (quaternary ammonium salt), COPY BLUE® PR (triphenyl methane derivative), COPY CHARGE® NEG VP2036 and NX VP434 (quaternary ammonium salt), by Hoechst AG; LRA-901, and LR-147 (boron complex), by Japan Carlit Co., Ltd.; as well as copper phthalocyanine, perylene, quinacridone, azo pigments and polymeric compounds having a functional group such as a sulfonate group, a carboxyl group, a quaternary ammonium group or the like. Among these there are preferably used, in particular, charge control agents that can control negative charge in the toner.

The content of the charge control agent, which is not particularly limited, is determined depending on the kind of binder resin used, on whether or not an additive is added, and on the toner manufacturing method (such as dispersion). However, the content of the charge control agent ranges ordinarily from 0.1 to 10 parts by weight, and preferably from 0.2 to 5 parts by weight, relative to 100 parts by weight of the binder resin. When the content of charge control agent exceeds 10 parts by weight, the chargeability of the toner becomes excessive and the effect of the charge control agent is weakened. The electrostatic attraction force of the developing roller 132 increases as a result, which reduces developer fluidity and image density.

(Release Agent)

Suitable release agents include waxes having a melting point of from 50 to 120° C. The wax, which is dispersed in the binder resin, acts as an effective release agent between the fixing roller and the toner interfacial surface. Hot offset resistance can be improved thereby without applying a release agent such as oil or the like to the fixing roller. Examples of waxes that can be used may be a natural wax including vegetable waxes, such as carnauba wax, cotton wax, Japan wax and rice wax; animal waxes, such as bees wax and lanolin; mineral waxes, such as ozokerite and ceresine; and petroleum waxes, such as paraffin waxes, microcrystalline waxes and petrolatum. In addition, synthetic waxes can also be used. Specific examples of the synthetic waxes include synthetic hydrocarbon waxes such as Fischer-Tropsch waxes and polyethylene waxes; and synthetic waxes such as ester waxes, ketone waxes and ether waxes. Further examples include fatty acid amides such as 1,2-hydroxylstearic acid amide, stearic acid amide and phthalic anhydride imide; and low molecular weight crystalline polymers such as acrylic homopolymers and copolymers having a long alkyl group in their side chain, such as poly-n-stearyl methacrylate, poly-n-laurylmethacrylate and n-stearyl acrylate-ethyl methacrylate copolymers.

The charge control agent and the release agent can be kneaded with a master batch and a binder resin. Needless to say, the charge control agent and the release agent can be dissolved or dispersed in an organic solvent.

(External Additive)

Inorganic microparticles are preferably used as the external additive for assisting in improving the fluidity and developing properties and chargeability of the toner particles. Preferably, the inorganic microparticles have a primary particle diameter of $5\times10^{-3}$ to 2 μm, and more preferably from $5\times10^{-3}$ to 0.5 μm. In addition, the specific surface area of such inorganic microparticles ranges preferably from 20 to 500 $m^2/g$, as measured by BET. The content of inorganic microparticles in the toner ranges preferably from 0.01 to 5 wt %, and more preferably from 0.01 to 2.0 wt % relative to the toner.

Specific examples of such inorganic microparticles include, for instance, silica, alumina, titanium oxide, barium titanate, magnesium titanate, calcium titanate, strontium titanate, zinc oxide, tin oxide, quartz sand, clay, mica, sandlime, diatomaceous earth, chromium oxide, cerium oxide, red iron oxide, antimony trioxide, magnesium oxide, zirconium oxide, barium sulfate, barium carbonate, calcium carbonate, silicon carbide, silicon nitride or the like. Among the foregoing, a combination of hydrophobic silica microparticles and hydrophobic titanium oxide microparticles is preferably used as a fluidity-imparting agent. In particular, the electrostatic forces and van der Waals, forces between the external additive and the toner are improved dramatically when using hydrophobic silica and hydrophobic titanium microparticles that have an average particle diameter no greater than $5\times10^{-2}$ μm. As a result, the fluidity-imparting agent does not separate from the toner even when the toner is stirred and mixed in the developing device 13 for obtaining a desired charge level. Good image quality can be achieved thereby, without white spots or the like, while the amount of transfer residual toner can be likewise reduced.

When titanium oxide microparticles are used as the external additive, the resulting toner can stably yield toner images having excellent image density and environmental stability. As a secondary effect, however, the charge rising properties of the toner tend to deteriorate when the addition amount of the titanium oxide microparticles is greater than that of the silica microparticles. Charge rising properties, however, do not become impaired when the addition amount of hydrophobic silica microparticles and hydrophobic titanium oxide microparticles lies within a range from 0.3 to 1.5 wt %. Within that range, thus, desired charge rising properties can be obtained. That is, stable image quality can be achieved even after repeated copying.

A preferred toner manufacturing method is explained next, although the manufacturing method is not limited thereto.

(Toner Manufacturing Method)

1) Firstly, a toner material solution is prepared by dispersing a colorant, an unmodified polyester resin, a polyester prepolymer having isocyanate groups and a release agent, in an organic solvent.

Preferred organic solvents include volatile organic solvents having a boiling point below 100° C. so that the solvent can be easily removed after formation of toner mother particles. Specific examples of such organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, or the like, in combination of one or two or more thereof. In particular, aromatic solvents such as toluene and xylene, and halogenated hydrocarbons such as methylene chloride, 1,2-dichloroethane, chloroform and carbon tetrachloride are preferably used. The quantity of organic solvent ranges ordinarily from 0 to 300 parts by weight, preferably from 0 to 100 parts by weight and more preferably from 25 to 70 parts by weight relative to 100 parts by weight of the polyester prepolymer.

2) The toner material solution is emulsified in an aqueous medium in the presence of a surfactant and/or resin microparticles.

Suitable aqueous media include water, and mixtures of water with alcohols (such as methanol, isopropanol and ethylene glycol), dimethylformamide, tetrahydrofuran, cellosolves (such as methyl cellosolve) and lower ketones (such as acetone and methyl ethyl ketone), which are organic solvents.

The amount of aqueous medium ranges ordinarily from 50 to 2000 parts by weight, preferably from 100 to 1000 parts by weight, relative to 100 parts by weight of toner material solution. When the amount of aqueous medium is less than 50 parts by weight, the toner material solution disperses poorly, and toner particles having a predetermined particle diameter fail to be obtained. On the other hand, a content of aqueous medium in excess of 20,000 parts by weight is uneconomical.

A dispersant such as a surfactant, resin microparticles or the like can be appropriately added to improve the dispersion of the toner material solution in the aqueous medium.

Examples of surfactants include, for instance, anionic surfactants such as alkylbenzene sulfonates, α-olefin sulfonic acid salts, and phosphate esters; cationic surfactants such as amine salts (e.g., alkyl sulfonates, amino alcohol fatty acid derivatives, polyfunctional amine fatty acid derivatives, or imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts or benzethonium chloride); nonionic surfactants such as fatty acid amide derivatives, polyhydric alcohol derivatives or the like; and ampholytic surfactants such as alanine, dodecyldi(aminoethyl)glycine, di(octylaminoethyle)glycine, or N-alkyl-N,N-dimethylammonium betaine.

The effect of the surfactant can be brought out with very small addition amounts when using surfactants having fluoroalkyl groups. Preferred examples of anionic surfactants having fluoroalkyl groups include, for instance, fluoroalkyl carboxylic acids having from 2 to 10 carbon atoms, and metal salts thereof, disodium perfluorooctanesulfonylglutamate, sodium 3-[omega-fluoroalkyl(C6 to C11)oxy]-1-alkyl(C3 to C4) sulfonate, sodium 3-[omega-fluoroalkanoyl(C6 to C8)-N-ethylamino]-1-propanesulfonate, fluoroalkyl (C11 to C20) carboxylic acids and metal salts thereof, perfluoroalkylcarboxylic acids (C7 to C13) and metal salts thereof, perfluoroalkyl(C4 to C12)sulfonate and metal salts thereof, perfluorooctanesulfonic acid diethanol amides, N-propyl-N-(2-hydroxyethyl)perfluorooctanesulfone amide, perfluoroalkyl (C6 to C10)sulfoneamidepropyltrimethylammonium salts, salts of perfluoroalkyl (C6 to C10)-N-ethylsulfonyl glycin, monoperfluoroalkyl(C6 to C16)ethylphosphate ester or the like.

Examples of commercial products of such surfactants having fluoroalkyl groups include, for instance, SURFLON® S-111, S-112 and S-113, by Asahi Glass Co., Ltd.; FRORARD® FC-93, FC-95, FC-98 and FC-129, by Sumitomo 3M Ltd.; UNIDYNE® DS-101 and DS-102, by Daikin Industries, Ltd.; MEGAFACE® F-110, F-120, F-113, F-191, F-812 and F-833 by Dainippon Ink and Chemicals, Inc.; ECTOP® EF-102, 103, 104, 105, 112, 123A, 123B, 306A, 501, 201 and 204, by Tohchem Products Co., Ltd.; FUTARGENT® F-100 and F150 by Neos.

Examples of cationic surfactants include, for instance, primary, secondary and tertiary aliphatic amino acids, aliphatic quaternary ammonium salts (such as perfluoroalkyl(C6 to C10)sulfoneamidepropyltrimethylammonium salts), benzalkonium salts, benzethonium chloride, pyridinium salts, imidazolinium salts or the like. Specific examples of commercial products thereof include SURFLON® S-121 (by Asahi Glass Co., Ltd.); FRORARD® FC-135 (by Sumitomo 3M Ltd.); UNIDYNE® DS-202 (by Daikin Industries, Ltd.); MEGAFACE® F-150 and F-824 (by Dainippon Ink and Chemicals, Inc.); ECTOP® EF-132 (by Tohchem Products Co., Ltd.); FUTARGENT® F-300 (by Neos) or the like.

Resin microparticles can be added to stabilize the toner mother particles formed in the aqueous medium. To that end, the resin microparticles are preferably added so as to cover the surface of the mother toner particles to a covering ratio from 10 to 90%. Examples of the resin microparticles include, for instance, polymethylmethacrylate microparticles from 1 to 3 μm, polystyrene microparticles from 0.5 to 2 μm, polystyrene-acrylonitrile microparticles having a particle diameter of 1 μm or the like, as well as commercial products such as PB-200H (by Kao Corp.), SGP (by Soken Chemical & Engineering Co., Ltd.), TECHNOPOLYMER® SB (by Sekisui Plastics Co., Ltd.), SPG-3G (by Soken Chemical & Engineering Co., Ltd.), MICROPEARL® (by Sekisui Fine Chemical Co., Ltd.) or the like.

An inorganic compound dispersant can also be used, for instance, tricalcium phosphate, calcium carbonate, titanium oxide, colloidal silica, hydroxyapatite or the like.

Dispersion droplets may also be stabilized by using a polymeric protective colloid as a dispersant employed concomitantly with the above-described resin microparticles and/or inorganic compound dispersants. Examples of polymeric protective colloids include, for instance, polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate ester, diethylene glycol monomethacrylate ester, glycerin monoacrylate ester, glycerin monomethacrylate, N-methylolacrylamide and N-methylolmethacrylamide), vinyl alcohol and ethers thereof (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and methylol compounds thereof, acid chlorides (e.g., acrylic acid chloride and methacrylic acid chloride), and homopolymers having a nitrogen atom or an alicyclic ring having a nitrogen atom (e.g., vinyl pyridine, vinyl pyrrolidone, vinyl imidazole and ethylene imine), as well as copolymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds such as methyl cellulose, hydroxyethyl cellulose and hydroxypropyl cellulose.

The dispersion method is not particularly limited. Herein there can be used known dispersion equipment for low speed shearing dispersion, high speed shearing dispersion, friction dispersion, high pressure jet dispersion, ultrasonic dispersion or the like. Among the foregoing, high-speed shearing dispersion is preferred for adhering dispersion particles having a diameter of 2 to 20 μm. The revolutions of the high-speed shearing disperser are not particularly limited, but range ordinarily from 1,000 to 30,000 rpm, more preferably from 5,000 to 20,000 rpm. The dispersion time is not particularly limited, and ranges ordinarily from 0.1 to 5 minutes in batch operations. The temperature during the dispersion process ranges ordinarily from 0 to 150° C. (under pressure), preferably from 40 to 98° C.

3) Simultaneously with the emulsifying operation, the amine (B) is added and reacted with the polyester prepolymer (A) having isocyanate groups.

This reaction accompanies crosslinking and/or extension of the molecular chains of the polyester prepolymer (A). The reaction time is determined depending on the reactivity of the amine (B) with the isocyanate group structure of the polyester prepolymer (A), but ranges typically from 10 minutes to 40 hours, preferably from 2 to 24 hours. The reaction temperature ranges ordinarily from 0 to 150° C., preferably from 40 to 98° C. Known catalysts may also be used, as the case may require, for instance dibutyltin laurate, dioctyltin laurate or the like.

4) After the reaction, the organic solvent is removed from the emulsified dispersion (reaction product), followed by washing and drying, to yield toner mother particles.

To remove the organic solvent, the temperature of the entire system is gradually raised under laminar-flow agitation. At a certain temperature range, the system is then agitated vigorously, followed by solvent removal, to prepare spindle-like toner mother particles. When using compounds such as calcium phosphate, which are soluble in acids and alkalis, as a dispersion stabilizer, it is preferable to dissolve the compound by adding an acid such as hydrochloric acid, followed by washing of the toner mother particles with water, to remove calcium phosphate therefrom. In addition, calcium phosphate can be removed using a zymolytic method.

5) The charge control agent is then fixed into the toner mother particles thus obtained, followed by addition of inorganic microparticles such as silica microparticles, titanium oxide microparticles or the like, to yield a toner.

Fixation of the charge control agent and addition of the inorganic microparticles can be carried out in accordance with known methods using, for instance, a mixer or the like.

The above method allows obtaining easily toner having a small particle diameter and a narrow particle diameter distribution. Also, vigorous agitation during removal of the organic solvent allows controlling the shape of the toner to range between a perfect sphere and a rugby-ball shape, and allows controlling surface morphology of the toner to range between a smooth and craggy surface.

The developing device 13 can be supported together with the photosensitive member 11, as a single unit, in the form of a process cartridge 110 that is removably mountable on the main body of the image forming apparatus 100. The process cartridge 110 may comprise, in addition, a charging device 12 and a cleaning device 15.

Figure 15:
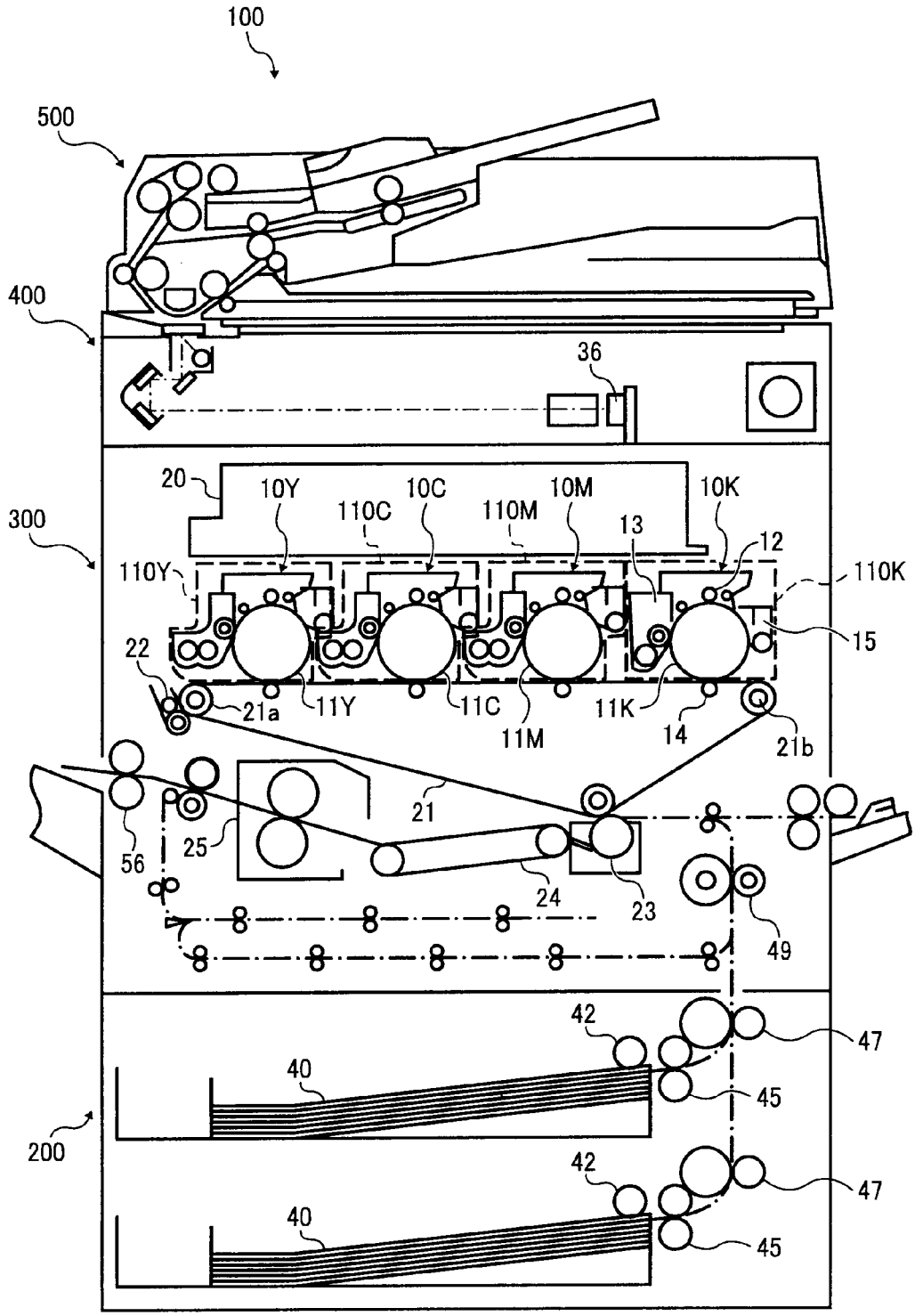
FIG. 15 is a diagram illustrating schematically the overall constitution of an image forming apparatus according to an embodiment of the invention, in which four image forming units are disposed in parallel.

FIG. 15 illustrates the constitution of an image forming apparatus in a first embodiment of the present invention. In the image forming apparatus there are arranged, side by side, four image forming units.

The copier in the figure, as an example of the image forming apparatus of the present invention, comprises a document feeder (ADF) 500 for feeding documents, a scanner 400 for reading the documents, and a printer 300 for forming images on transfer paper, on the basis of digital signals outputted by an image processing unit that electrically processes the digital signals outputted by the scanner 400. In the scanner 400, the images on the document placed on a document placing table are captured by a color CCD 36, via an irradiation lamp, mirrors and lenses. The data in the CCD 36 are transmitted to the image processing unit. In the processing unit, the data are subjected to the required processing, to be converted into image signals that are sent to the printer 300.

In the printer 300 there are arranged four image forming units 10Y, 10C, 10M, 10K for yellow, cyan, magenta and black, as well as one intermediate transfer belt 10 and one secondary transfer roller 23 for the four image forming units 10. Each image forming unit 10 may form one process cartridge 110. When the image forming operation is initiated in the yellow image forming unit 10Y, the surface of the photosensitive member 11, which is an electrostatic image carrier, is uniformly charged by the charging device 12. After charging, an electrostatic latent image of the yellow component image of the full color document is formed, on the photosensitive member 11, by exposure light from an exposure device 20. The electrostatic latent image is developed with yellow toner by the yellow developing device 13Y. With predetermined time differences, the same image forming operation is performed in the cyan image forming unit and the magenta image forming unit, to form cyan and magenta toner images on the respective photosensitive members 11. Next, a black toner image is formed on the photosensitive member 11K by the black image forming unit 10. Lastly, transfer rollers 14 are disposed opposite the photosensitive members 11 of each image forming unit 10, on the reverse face of the intermediate transfer belt 21, such that a predetermined transfer bias applied to the transfer rollers 14 causes the toner images of the respective image forming units 10 to be transferred, by sequential superposition, onto the intermediate transfer belt 21, in order to superpose the toner images Y, C, M, Bk formed on the photosensitive members 11 of the respective image forming units 10Y, 10C, 10M, 10Bk, on the intermediate transfer belt 21, as a single full color image. The toner image on the intermediate transfer belt 21, having become now one full color image, is transferred onto transfer paper, which is fed with appropriate timing between the intermediate transfer belt 21 and a secondary transfer roller 23 to which a predetermined bias is applied. Thereafter, the transfer paper is conveyed to a fixing device 25 where the transfer paper is heated and pressed to fix the toner image on the transfer paper, to output a full color image. The transfer device comprises, for instance, the primary transfer roller 14, the secondary transfer roller 23, the intermediate transfer belt 21 and a belt cleaning device 22.

In the image forming apparatus of the present invention, the color toners such as yellow and so forth use a two-component developer, although the black toner may employ a one-component developer. Unless some other distinctive effect is afforded thereby, the image forming operation does not diverge, in particular, from the below-described operation.

After transfer onto the intermediate transfer belt 21, the surface potential of the photosensitive member 11 in the respective image forming unit 10 is removed by an optical charge removal unit, not shown. The transfer residual toner remaining on the photosensitive member 11 is removed by cleaning blades 151, 152 of the cleaning device 15, and then the photosensitive member 11 is charged again by the charging device 12, as described above. This series of image forming cycles are carried out repeatedly. After belt transfer, the charge on the surface of the photosensitive member 11 is removed by the optical charge removing unit. Thereafter, residues of toner and so forth are removed in the cleaning device 15. The toner removed by the cleaning device 15 is conveyed to a waste toner storage tank via a waste toner transport duct.

The charging device 12 is a contact charging-type charging device, in which a charging member 12*a*, arranged opposite the photosensitive member 11, is brought into contact with the latter to charge uniformly the surface of the photosensitive member 11 through application of a predetermined direct-current voltage (DC). An elastic resin roller is used in the charging member. A contactless potential sensor is disposed at a position opposite the photosensitive member surface, between an exposure position and a development position on the surface of the photosensitive member, in the rotation direction of the photosensitive member. The charging bias and the exposure amount are adjusted so as to achieve a predetermined charging potential and a predetermined latent image potential.

Material such as residual toner, paper dust or the like that becomes adhered to the surface of intermediate transfer belt 21, after transfer of the full color toner image onto the transfer paper, is removed by a cleaning brush roller and/or a cleaning blade, not shown, of the intermediate transfer belt cleaning device 22. Thereupon, the waste toner is conveyed to a waste toner storage section, as is the case with the above-described photosensitive member waste toner. The transfer belt can be switched between being in contact with the photosensitive member 11 of the respective image forming unit 10, or being separated from the latter, through application or release of tension on the transfer belt, via a cam mechanism, by a tension roller disposed in the transfer unit that comprises the intermediate transfer belt 21, the transfer rollers, a transfer bias power supply, a belt driving shaft and so forth. As a result, the intermediate transfer belt 21 is brought into contact with the photosensitive member 11 of the respective image forming unit prior to rotation of the latter, during machine operation, and is moved away from the photosensitive member 11 during machine stop. After transfer of the toner image to the intermediate transfer belt, the charge on the surface of the photosensitive members is removed by the optical charge removing units. In the cleaning device 15, firstly the adherence of residual toner and adhered material on the photosensitive member 11 is weakened through scraping by a brush roller (at a position upstream in the rotation direction of the photosensitive member 11 in the cleaning device 15). To that end, the brush roller rotates, while in contact with the photosensitive member 11, in a direction counter to the rotation direction of the photosensitive member 11. At a downstream position, meanwhile, a blade made of a rubber elastic material is brought into contact with the photosensitive member 11, to remove the above-described disturbed toner and adhered material.

The image forming apparatus of the present invention may comprise supply means, not shown, for supplying a lubricant to the intermediate transfer body 10. The lubricant supplied is not particularly limited, and may be any material having a lubricating effect. Examples of the lubricant that can be used include, for instance, solid lubricants such as fluororesins, e.g. PTFE, PVDF or the like, silicone resins, polyolefin resins, paraffin wax, metal salts of fatty acids such as stearic acid, lauric acid, palmitic acid or the like, graphite or molybdenum disulfide. Preferred among the foregoing are metal stearates, as metal salts of fatty acids, and fluororesins, as resin micropowders.

The developing device, the process cartridge and image forming apparatus of the present invention comprise thus a member that fills up the space above a regulating member, or the developing device housing is shaped in such a manner that the space above the regulating member is filled, so that toner, as a one-component developer, does not penetrate directly into the nip between a developing roller and a supply roller. Even when toner is consumed, non-degraded toner is transported as a result directly to the regulating member, and thus toner charge does not vary abruptly on the developing roller, while toner charge is stabilized regardless of the amount of developer in the developing device, all of which allows obtaining high-quality images.

Various modifications will become possible for those skilled in the art after receiving the teachings of the present disclosure without departing from the scope thereof.

What is claimed is:

1. A developing device using a one-component developer, comprising:

a developer carrier that is rotatable;

a developer supply member that is rotatable and in contact with the developer carrier at a nip;

a developer storing section above the developer supply member;

a regulating member, pressing against the developer carrier, for homogenizing toner on the developer carrier;

a filling member for filling a space above the regulating member, to prevent toner located above the toner-homogenizing regulating member from intruding into the nip, the filling member arranged such that at least a portion of the developer supply member is directly below, in a vertical direction, a top of the developing device, and at least a portion of the developer carrier is directly below the filling member; and a bottom having a shape that allows the developer supply member to rotate.

2. The developing device according to claim 1, further comprising a pressure reducing member for preventing the pressure of the developer in the developer storing section from acting on the regulating member, the pressure reducing member being formed integrally with the filling member.

3. The developing device according to claim 1, wherein the filling member does not hamper flow of the one-component developer being recovered from the regulating member to the developer storage section.

4. The developing device according to claim 1, wherein the filling member is integrally formed with a developing device housing.

5. The developing device according to claim 1, wherein:

a vertical edge of the filling member is vertically above the nip.

6. The developing device according to claim 1, wherein:

an entire part of the developer supply member that faces upwardly faces directly to the top of the developing device, except for the portion of the developer supply member at the nip.

7. A process cartridge that is detachably mountable on an image forming apparatus, and integrally supporting at least an image carrier and a developing device, the developing device comprising:

a developer carrier that is rotatable;

a developer supply member that is rotatable and in contact with the developer carrier at a nip;

a developer storing section above the developer supply member;

a regulating member, pressing against the developer carrier, for homogenizing toner on the developer carrier;

a filling member for filling a space above the regulating member, to prevent toner located above the toner-homogenizing regulating member from intruding into the nip, the filling member arranged such that at least a portion of the developer supply member is directly below, in a vertical direction, a top of the developing device, and at least a portion of the developer carrier is directly below the filling member; and a bottom having a shape that allows the developer supply member to rotate.

8. The process cartridge according to claim 7, wherein the developing device is provided with a pressure reducing member for preventing the pressure of the developer in the developer storing section from acting on the regulating member, the pressure reducing member being formed integrally with the filling member.

9. The process cartridge according to claim 7, wherein the filling member does not hamper flow of the one-component developer being recovered from the regulating member to the developer storage section.

10. The process cartridge according to claim 7, wherein the filling member is integrally formed with a developing device housing.

11. The process cartridge according to claim 7, wherein:

a vertical edge of the filling member is vertically above the nip.

12. The process cartridge according to claim 7, wherein:

an entire part of the developer supply member that faces upwardly faces directly to the top of the developing device, except for the portion of the developer supply member at the nip.

13. An image forming apparatus, comprising:

an image carrier for forming a latent image;

a charging device for uniformly charging the surface of the image carrier;

an exposure device for exposing the surface of the charged image carrier, and writing a latent image thereon, on the basis of image data;

a developing device for supplying toner to the latent image formed on the surface of the image carrier, to develop a visible image;

a transfer device for transferring the visible image on the surface of the image carrier to a transfer material, directly or after transfer to an intermediate transfer body; and a fixing device for fixing the toner image on the transfer material, the developing device comprising:

a developer carrier that is rotatable;

a developer supply member that is rotatable and in contact with the developer carrier at a nip;

a developer storing section above the developer supply member;

a regulating member, pressing against the developer carrier, for homogenizing toner on the developer carrier;

a filling member for filling a space above the regulating member, to prevent toner located above the toner-homogenizing regulating member from intruding into the nip, the filling member arranged such that at least a portion of the developer supply member is directly below, in a vertical direction, a top of the developing device, and at least a portion of the developer carrier is directly below the filling member; and a bottom having a shape that allows the developer supply member to rotate.

14. The image forming apparatus according to claim 13, wherein the developing device is provided with a pressure reducing member for preventing the pressure of the developer in the developer storing section from acting on the regulating member, the pressure reducing member being formed integrally with the filling member.

15. The image forming apparatus according to claim 13, wherein the filling member does not hamper flow of the one-component developer being recovered from the regulating member to the developer storage section.

16. The image forming apparatus according to claim 13, wherein the filling member is integrally formed with a developing device housing.

17. The image forming apparatus according to claim 13, wherein:

a vertical edge of the filling member is vertically above the nip.

18. The image forming apparatus according to claim 13, wherein:

an entire part of the developer supply member that faces upwardly faces directly to the top of the developing device, except for the portion of the developer supply member at the nip.

* * * * *